US006705650B2

(12) United States Patent
Ohnishi et al.

(10) Patent No.: US 6,705,650 B2
(45) Date of Patent: Mar. 16, 2004

(54) FASTENING STRUCTURE

(75) Inventors: Yohichi Ohnishi, Okazaki (JP); Tomohiro Osuka, Kariya (JP)

(73) Assignees: Toyota Jidosha Kabushiki Kaisha, Toyota (JP); Toyoda Boshoku Corporation, Kariya (JP)

( * ) Notice: Subject to any disclaimer, the term of this patent is extended or adjusted under 35 U.S.C. 154(b) by 0 days.

(21) Appl. No.: 09/842,112

(22) Filed: Apr. 26, 2001

(65) Prior Publication Data

US 2001/0038212 A1 Nov. 8, 2001

(30) Foreign Application Priority Data

Apr. 27, 2000 (JP) ..... 2000-127339

(51) Int. Cl.[7] ..... E05C 3/14

(52) U.S. Cl. ..... 292/242; 292/DIG. 11; 55/385.3

(58) Field of Search ..... 292/240–242, 292/57–64, 67, 71, DIG. 11; 220/324; 55/385.2, 385.4, 480, 493, 502

(56) References Cited

U.S. PATENT DOCUMENTS

| | | | | | |
|---|---|---|---|---|---|
| 19,891 | A | * | 4/1858 | Woolman | 292/241 |
| 588,063 | A | * | 8/1897 | Hewens | 292/241 |
| 595,428 | A | * | 12/1897 | Adams | 292/241 |
| 1,490,694 | A | * | 4/1924 | Brabson | 292/241 |
| 1,853,851 | A | * | 4/1932 | Dorey | 292/241 |
| 2,235,949 | A | * | 3/1941 | Shaw | 292/241 |
| 2,389,184 | A | * | 11/1945 | Cooke | 292/241 |
| 2,782,957 | A | | 2/1957 | Imparato | |
| 2,932,873 | A | | 4/1960 | Reichert | |
| 3,329,456 | A | * | 7/1967 | Olander | 292/241 |
| 3,660,969 | A | * | 5/1972 | Fox | 55/385 |
| 3,860,273 | A | * | 1/1975 | Petrus | 285/244 |
| 4,989,636 | A | * | 2/1991 | Hunter | 137/557 |
| 5,209,614 | A | | 5/1993 | Matthews | |
| 5,295,602 | A | * | 3/1994 | Swanson | 220/306 |
| 5,549,723 | A | * | 8/1996 | Terry | 55/493 |
| 6,267,793 | B1 | * | 7/2001 | Gomez et al. | 55/385.2 |

FOREIGN PATENT DOCUMENTS

| | | |
|---|---|---|
| DE | 195 17 278 | 11/1995 |
| EP | 0 677 663 | 10/1995 |
| GB | 2 081 367 | 2/1982 |
| JP | (P) HEI07-247923 | 9/1995 |
| JP | (P) HEI07-324655 | 12/1995 |
| JP | (P) HEI08-281033 | 10/1996 |

* cited by examiner

*Primary Examiner*—Gary Estremsky
(74) *Attorney, Agent, or Firm*—Kenyon & Kenyon

(57) ABSTRACT

A first column-like portion of a hook rod, substantially oval-shape in cross section, is fitted in hooks and then turned around its longitudinal axis by about 90°. Since a diameter in the vertical direction facing to a lower surface of the hook from the center of the first column-like portion having a substantially oval-shape in cross section increases with turning, pressing force becomes larger as the turning angle increases. Therefore, based on the pressing force an upper surface at a flange is pressed toward a flange of a case by a part positioned at the lower end in an outer peripheral surface. Based on the pressing force the flanges, an element peripheral portion sandwiched therebetween is elastically pressed to shrink, whereby the case and the cap are fastened by a simple operation of only fitting and turning the first column-like portion in recesses of the hooks.

14 Claims, 17 Drawing Sheets

FASTENING STRUCTURE

INCORPORATION BY REFERENCE

The disclosure of Japanese Patent Application No. 2000-127339 filed on Apr. 27, 2000 including the specification, drawings and abstract is incorporated herein by reference in its entirety.

BACKGROUND OF THE INVENTION

1. Field of the Invention

The invention relates to a fastening device for fastening two parts at a peripheral portion.

2. Description of Related Art

For example, an air cleaner apparatus for a vehicle is constituted by a case (first housing) having a first opening and an air inlet, a cap (second housing) having a second opening which is facing to the first opening and an air outlet, a filter element wherein a seal member is mounted to the outer peripheral portion and sandwiched at each of the peripheral portion of the case and the cap, and the like. By connecting the case and the cap, for example, with a hinge structure, at one side of the peripheral portion, they are integrated to be relatively turnable around the hinge. By placing one peripheral portion over the other with the filter element sandwiched therebetween to be in a state where the first opening and the second opening are closed each other, they are fastened at other side in the peripheral portion with a metal clamp or the like.

FIG. 21 shows an example of the above-mentioned fastening structure, for example, as described in Japanese Laid-Open Publication No. Hei 8-281033. In FIG. 21 a clamp 194 is mounted to a flange 192 provided to project toward the outer peripheral portion on top end of a case 190 so as to be turnable around the axis center vertical to the paper face. The clamp 194 is formed by bending a thin metal plate in the direction of its surface to be apart from the flange 192 at the intermediate part in the longitudinal direction and having an engaging potion 196 formed by bending further greatly to face to the flange 192 at the extreme end side on the opposite side to the turning axis center. When the case 190 and the cap 198 are fastened with such a clamp 194, these flanges 192, 200 are put together and the clamp 194 is turned to the left direction in the drawing and the engaging portion 196 is projected to the flange 200 by pressing an operating part 202 provided at the extreme end toward the cap 198.

However, in the fastening structure by means of the above-mentioned clamp 194, applied force F1 required for fastening is given by F1=(L2/L1)F2; where resisting force F2 is for the engaging portion 196 to go over an angular portion at the edge of the flange 200, and L2 which cannot be universally set is defined by thickness of the flanges 192, 200, and thickness of a filter element not shown in the drawing. Therefore, since L1 to L2 cannot be set that long in the engine room of a vehicle where a dead space is desirably diminished as much as possible, there has been a problem that workability is bad because assembly load cannot be reduced at the time of fastening. such a problem is not limited to the above-mentioned air cleaner fastening structure for a vehicle, and it possibly occurs similarly as long as fastening structure where two parts are laid one over-the other at their peripheral portion and fastened with a clamp or the like.

SUMMARY OF THE INVENTION

The invention has been accomplished against the background of the foregoing circumstances and its object is to provide a fastening structure capable of reducing assembly load with a simple constitution.

In an aspect of a fastening structure according to the invention to accomplish such an object, a first peripheral portion of a first part and a second peripheral portion of a second part are put together and pressed to each other, whereby the first part and the second part are fastened. This fastening structure includes a first engaging portion provided with a first sliding contact surface facing to the second peripheral portion side at the opposite side to the first part in relation to the second peripheral portion and extending to the second part from the first part, a second engaging portion provided to the fastening part so as to be engaged with the first engaging portion and be relatively turnable around the predetermined turning axis, a second sliding contact surface provided to the second engaging portion so as to come in contact with the first sliding contact surface in the engaged state of the fastening part with the first engaging portion wherein pressing force applied from the first sliding contact surface increases as the fastening part is turned around a predetermined turning axis in the fastening direction, a peripheral portion pressing surface provided to the fastening part so as to press the second peripheral portion toward the first peripheral portion based on the pressing force and an operating part provided to the fastening part at a predetermined interval from the turning axis in order to turn the second engaging part around the turning axis against the first engaging part in the predetermined turning axis direction.

In such a manner, when the first peripheral portion of the first part and the second peripheral portion of the second part are put together and the second engaging portion of the fastening part is engaged with the first engaging portion extending from the first part and then the second engaging portion is turned against the first engaging portion in the fastening direction by operating the operating part of the fastening part, pressing force according to the turning amount is applied to the second sliding contact surface from the first sliding contact surface facing to the side of the second peripheral portion and based on this pressing force the peripheral portion pressing surface of the fastening part presses the second peripheral portion toward the first peripheral portion, whereby the first peripheral portion and the second peripheral portion are fastened. At this time, the required force for turning the second engaging portion, that is, assembly load is smaller as a fulcrum-point of force-application distance from the turning axis center to the operating part in relation to a fulcrum-working point distance from the turning axis center to the peripheral portion pressing surface increases, however, the fulcrum-working point distance can be set small regardless of a thickness of the first peripheral portion and the second peripheral portion to such an extent that the torsional stress being applied to the fulcrum does not exceed the tolerable value. Therefore, a fastening structure capable of reducing the assembly load with a simple constitution can be obtained.

DETAILED DESCRIPTION OF PREFERRED EMBODIMENTS

Hereinafter, an embodiment of the invention will be explained particularly with reference to the drawings.

Figure 1:
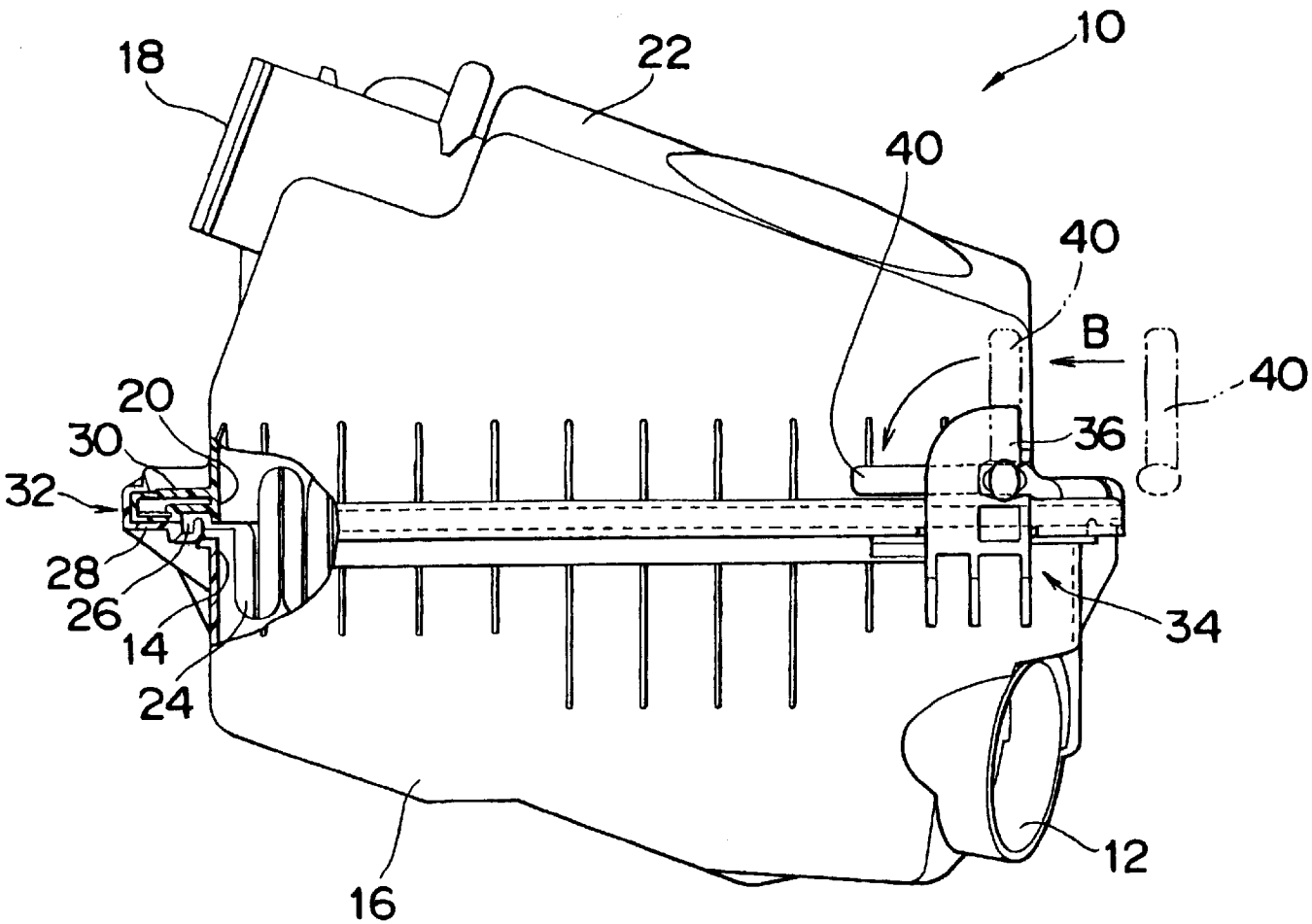
FIG. 1 is a front view explaining the entire constitution of an air cleaner apparatus to which a fastening structure according to an embodiment of the invention is applied.
Figure 2:
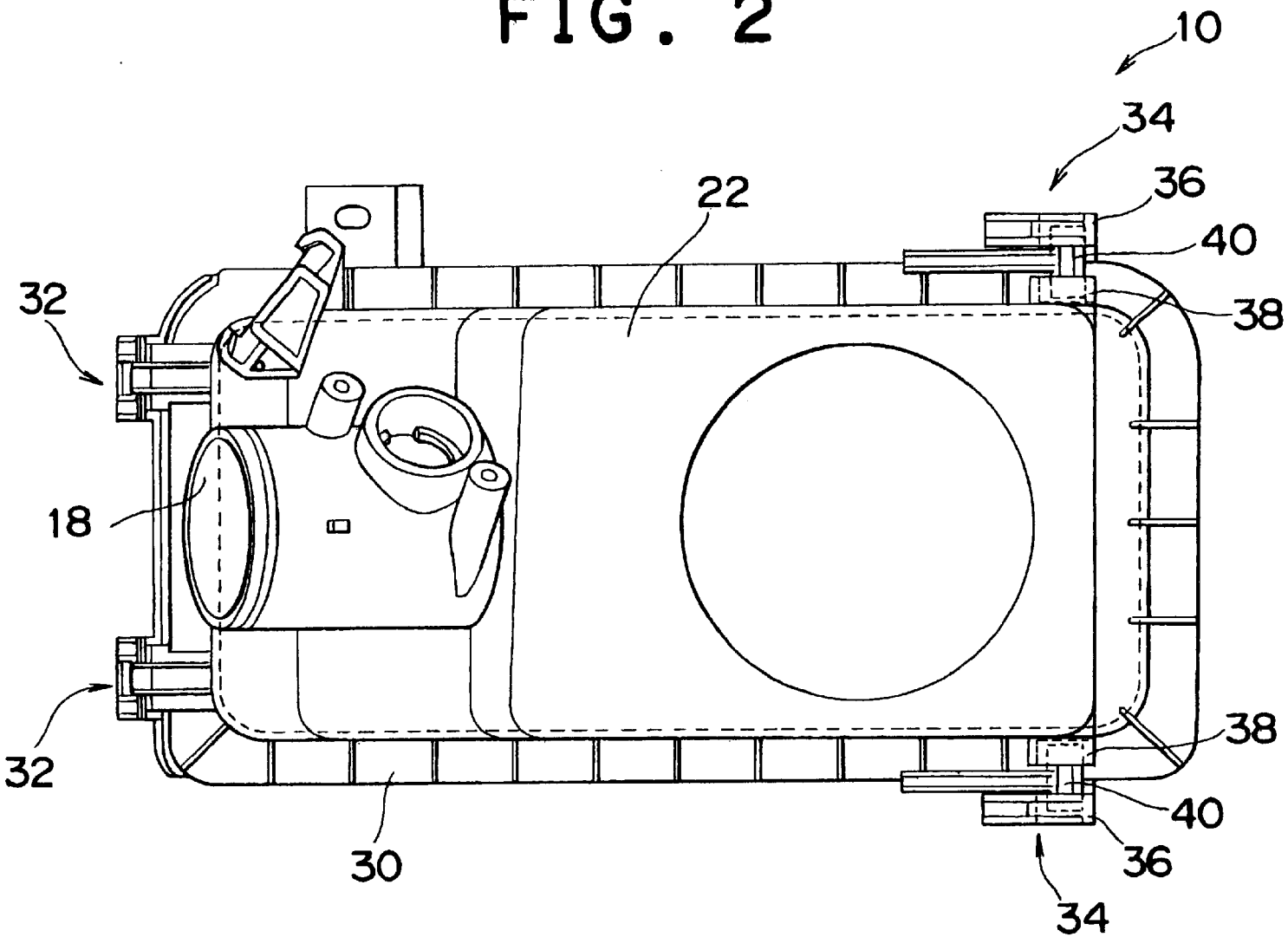
FIG. 2 is a plan view of the air cleaner apparatus of FIG. 1.

FIG. 1 and FIG. 2 are a front view and a plan view showing the entirety of an air cleaner apparatus 10 to which a fastening structure of the invention is applied, respectively. As shown in FIG. 1 and FIG. 2, the air cleaner apparatus 10 is provided with a case 16 having an air inlet 12 and an opening 14, and a cap 22 having an air outlet 18 and an opening 20. The case 16 and the cap 22 are connected in such a manner that the opening 14 and the opening 20 are facing to each other and closing each other. And an internal space which is substantially airtight is formed between the case 16 and the cap 22. For example, the case 16 is provided with a thread or the like (not shown) for securing in an engine room of a vehicle at a suitable position of the outer peripheral face. Both of the case 16 and the cap 22 are made of thermosetting resin. In this embodiment, the case 16 and the cap 22 correspond to the first part and the second part, respectively.

Moreover, FIG. 1 shows an internal structure being partially broken away in the vicinity of the boundary between the case 16 and the cap 22. A filter element 24 is provided in the internal part of a container constituted by the case 16 and the cap 22. Flanges 28,30 are provided to the case 16 and the cap 22 in such a manner that they expand outward from the entire periphery of the opening ends and the filter element 24 is held by being sandwiched between the case 16 and the flanges 28,30 of the cap at the peripheral portion 26. The filter element 24 is positioned in the intermediate part in the direction of height inside the container. The element peripheral portion 26 is constituted, for example, by rubber; resin coated with rubber or the like, and is held in a state where it is elastically pressed to shrink by the flanges 28,30. Incidentally, FIG. 5 and so on as described later show a case where the peripheral portion 26 is constituted only by rubber for convenience. In this embodiment, the flanges 28,30 correspond to a first peripheral portion and a second peripheral portion, respectively.

A pair of hinge devices 32 is provided to one side positioned at the left end in FIG. 1 and FIG. 2 at the boundary between the case 16 and the cap 22. In this embodiment the hinge device 32 is constituted, for example, by parts respectively projecting from flanges 28, 30 of the case 16 and the cap 22, and pinching each other. The cap 22 is turnable can be around the axis center vertical to the paper surface of FIG. 1 in relative to the case 16 with the hinge device 32 as a turning axis. When the cap 22 is turned to the left from the position shown in FIG. 1, the opposite side to a side provided with a hinge device 26 (the other side positioned at the right end in FIG. 1 and FIG. 2) comes apart from each other, and the internal space between the case 16 and the cap 22 becomes opened. Along with that, the held state of the filter element 24 by flanges 28,30 of the element peripheral portion 26 is released. The filter element provided inside is exchangeable by releasing the internal portion in such a manner.

Two sides parallel to each other extending from one side where the hinge device 32 is provided in the flanges 28,30 to the other side to be open are provided, for example, with a pair of fastening devices 34, respectively, in the adjacent portion to the other side that is the opening end side. The fastening device 34 is provided with a hook 36, a hook 38 and a hook rod 40. The hook 36 is formed to project outward from a top end side surface of the case 16 and extend toward the cap 22. The hook 38 is provided to face to the extreme end of the hook 36 on the flange 30 of the cap 22. The hook rod 40 is engaged with these hooks 36,38. The fastening device maintains a fastened state wherein the flanges 28,30 put the case 16 and the cap 22 together to be substantially airtight trough the filter element 24. All the hooks 36,38 and the hook rod 40 are made of thermosetting resin material similar to that of the case 16 and the cap 22 and are independent parts from one another as will be mentioned later. In this embodiment, the hook 36 and the hook 38 correspond to the first engaging portion and the third engaging portion, respectively.

Figure 3:
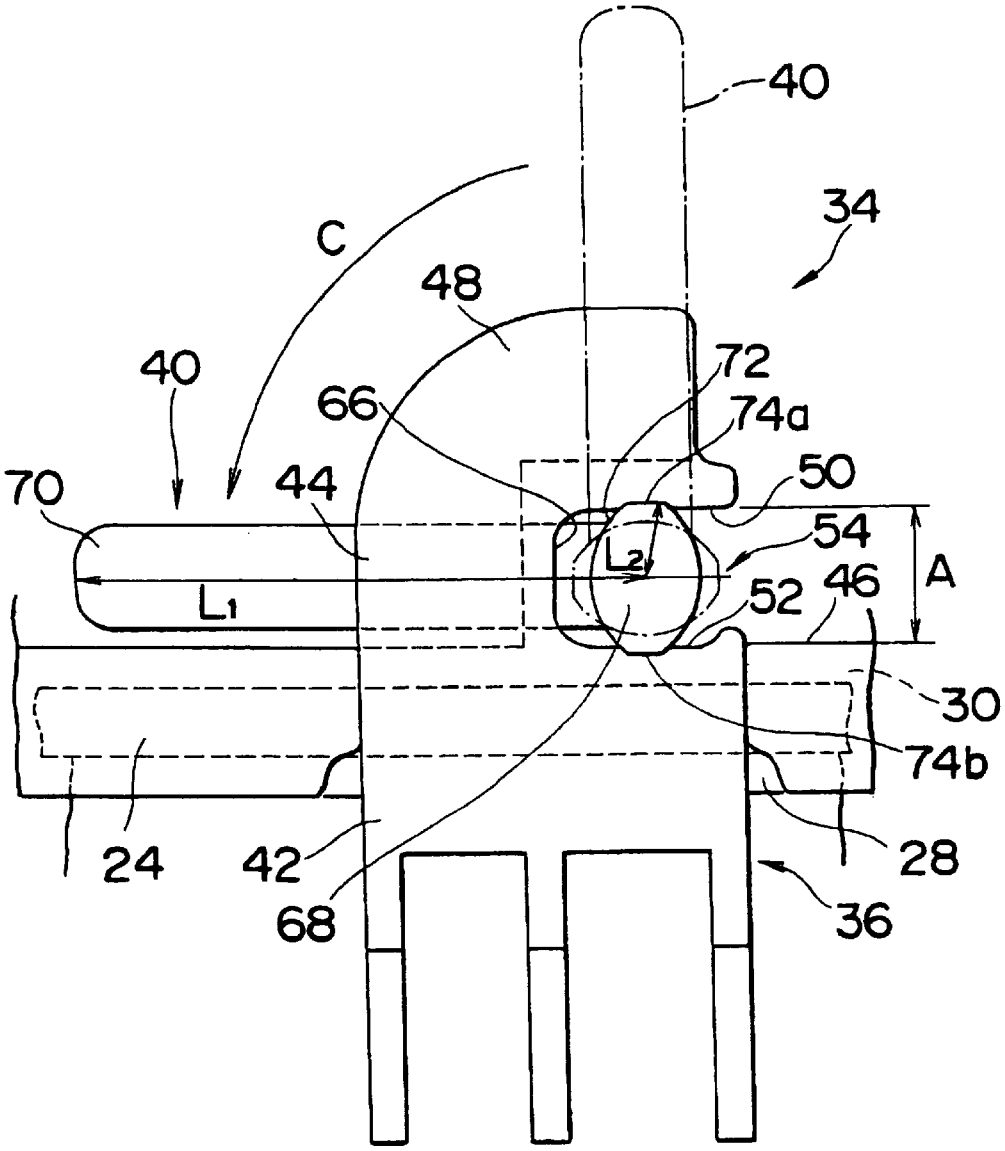
FIG. 3 is a front view explaining the constitution of the fastening device in detail with enlarged essence of the air cleaner apparatus of FIG. 1.
Figure 4:
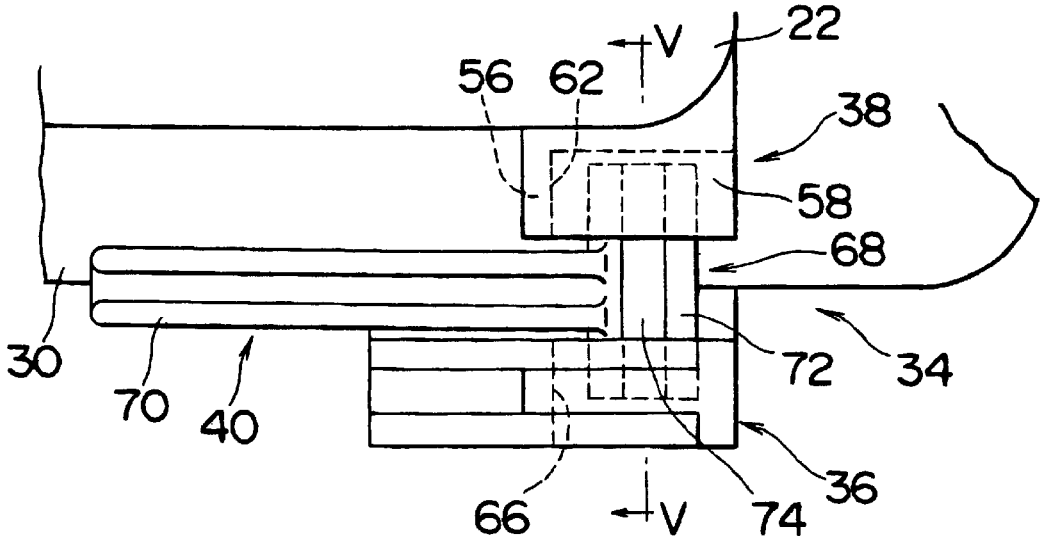
FIG. 4 is a plan view of the fastening device of FIG. 3.
Figure 5:
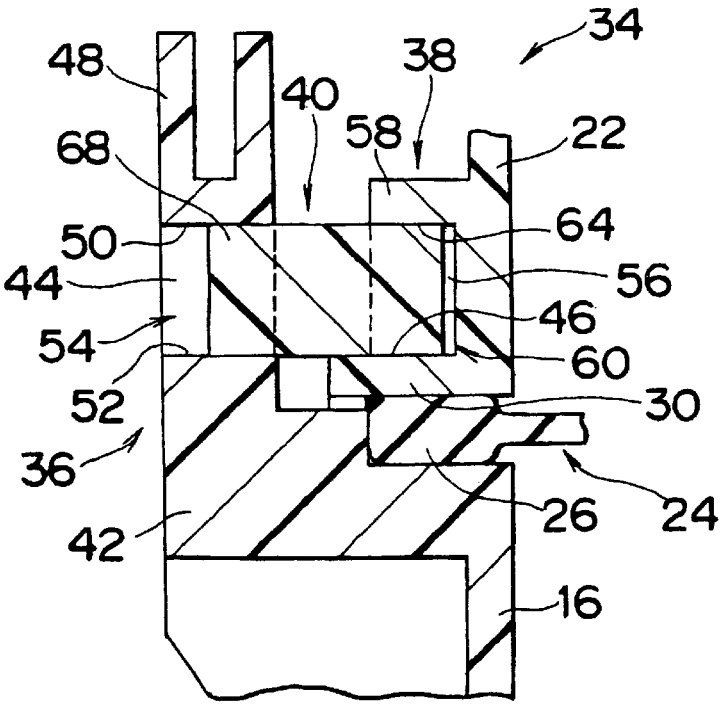
FIG. 5 is a sectional view viewed along line V—V of FIG. 4.

FIG. 3 and FIG. 4 are a front view and a plan view showing the enlarged essential portion in FIG. 1 and FIG. 2, respectively, for explaining the constitution of the fastening device 34. FIG. 5 is a sectional view viewed along line V—V in FIG. 4. The hook 36 is constituted by a first part 42, a second part 44 and a third part 48. The first part is formed to extend from the side wall of the case 16, and is positioned lower than the flange 30 of the cap 22 (at the side of the case 16) and corresponds to the lower end of the hook 36. The second part 44 of thinner width than that of the first part 42 extend upward so as to be apart from the case 16. The third part extends parallel to an upper surface 46 of the flange 30 from the top end of the second part 44. The second part 44 and the third part 48 are positioned higher than the flange 30 of the cap 22 (at the side of the cap 22) and correspond to the top end of the hook 36. Therefore, the top end of the hook 36 is formed to extend from the lower end in the size of a thinner width and to be bent from the top end of the extending portion toward the right in FIG. 3 and FIG. 4 so as to have a hook-like shape with the extending part whose right end is open. The lower surface 50 facing to the side of the flange 30 of the third part 48 is parallel to the upper surface 52 of the first part 42. Thereby, the hook 36 is formed with a recess 54 having a right end portion being open in FIG. 3 and FIG. 4 among the first part 42, the second part 44 and the third part 48. Incidentally, the upper surface 52 of the first part 42 is positioned substantially on the same surface as the upper surface 46 of the flange 30 or slightly lower than that in the fastened state as shown in FIG. 5. In this embodiment, the first part 42 and the second part 44 correspond to a leg portion; the third part 48 corresponds to a first sliding contact portion; and the lower surface 50 corresponds to the first sliding contactsurface, respectively.

Moreover, the hook 38 is constituted by a first part 56 extending upwardly from the flange 30 and a second part 58 extending parallel to the upper surface 46 of the flange 30 from the extreme end of the first part 56. The first part 56 extends from the flange 30 and the second part 58 extends from the side wall of the cap 22. Therefore, the hook 38 bends toward the right at its top end in FIG. 3 and FIG. 4, with a hook-like shape having the right end open and formed with a recess 60 having an opened right end in FIG. 3 and FIG. 4 between the flange 30 and the side wall of the cap 22. In the inner surface of the part having the hook-like shape, that is the inner surface 62 of the first part 56 and the lower surface 64 of the second part 58, the inner surface 62 is on the same plan surface as the inner surface 66 of the second part 44 of the hook 36, and the lower surface 64 is on the same plan surface with or slightly lower than the lower surface 50 of the third part 48 of the hook 36.

Moreover, the hook rod 40 forming entirely a substantially T-shape is provided with a first column-like portion 68 having a column-like configuration of a substantially oval cross section and the second column-like portion 70 having a column-like shape of a substantially circular cross section whose axis center direction extending along the substantially vertical direction to the center of the first column-like portion 68 in the direction of the axis center, forming from that center having a substantially T-shape as an entirety. The first column-like portion 68 has a pair of flat surfaces 74 at the both ends in the longitudinal direction of a substantially oval-shaped section in an outer peripheral surface 72. The second column-like portion 70 continues in the center between the pair of the flat surfaces 74 in the outer peripheral surface 72. The diameter of the second column-like portion 70 is substantially equal to the shorter diameter of the first column-like portion 68, therefore, the pair of the flat surfaces 74 project in its diametric direction further than the second column-like portion 70. The shorter diameter of the first column-like portion 68 is relatively smaller than space A between the upper and lower surfaces 50,52 of the hook 36, or the substantially same space of the upper and lower surfaces 64,46 of the hook 38, and the longer diameter (a relative space between the flat surfaces 74,74) is the same as or relatively larger that the space A.

The hook rod 40 having such a configuration is removed from the hooks 36,38 at such a time as exchanging of a filter element 24 held between the case 16 and the cap 22 and is operated as below when the case 16 and the cap 22 are fastened. First, after closing the case 16 and the cap 22 in the state shown in FIG. 1 etc., the first column-like portion 68 is fitted in the direction of the arrow B as shown in FIG. 1 from the right hand in FIG. 1 and FIG. 3 etc. so that one of the end surface sides rather than the second column-like portion 70 in the first column-like portion enters a recess 54 within the hook 36 and the other end surface side part enters a recess 60 within the hook 38 in the axis center direction of the first column-like portion 68 being substantially vertical to the edge of the flange 30 and substantially parallel to its upper surface 46. In this stage, the flange 30 of the cap 22 is pushed up higher than the position shown in FIG. 5, that is, in the direction apart from the case 16, by means of an element peripheral portion 26. Therefore, the upper surface 46 of the flange 30 is positioned closer to the lower surface 50 than the upper surface 52 of the hook 36, and the space between the upper surface 46 and the lower surface 50 is slightly smaller than A. At that time, a direction of the second column-like portion 70 of the hook rod 40 is the up-down direction in FIG. 3. That is, the direction of the shorter diameter of the first column-like portion 68 being smaller than the space A between the upper and lower surfaces 50,52 of the hook 36 is in the up-down direction in the drawing, therefore, pressing force is not applied at all among the first column-like portion 68, the hook 36 and the flange 30. However, because the space between the upper and lower surfaces 46,50 is smaller than A as described above, there is a case where small pressing force occurs in the first place depending on the relative sizes of the flange and fastener components.

After fitted into the position in the direction as shown by dot-dash lines in FIG. 3, the second column-like portion 70 is turned by about 90° to the position shown by a solid line in the arrow C direction about the axial turning of the first column-like potion 68 along the side wall surface of the cap 22. In this process of turning, due to the substantially oval-shaped section of the first column-like portion 68 as the second-column-like portion 70 is turned from the vertical direction to the lower surface 50 of the hook 36, an outer peripheral surface 72 contacts with the lower surface 50 at a turning angle where the degree corresponds to A, (precisely a turning angle corresponding to the distance between the upper and lower surfaces 46,50 becoming slightly smaller than A), thereafter, the larger the turning angle becomes, the larger pressing force is applied from the lower surface 50 to the outer peripheral surface 72. In other words, the outer peripheral surface 72 in the oval shape functions as a cam surface, the pressing force is corresponding to the gap between the diameter of a contacting part with the lower surface 50 of the hook 36 in the outer peripheral surface 72 of the first column-like portion 68 and the space of the upper surface 46 and the lower surface 50 in the initial state where flange 30 is pushed up to the element peripheral portion 26. Therefore, the upper surface 46 of the flange 30 is pressed toward the flange 28 of the case 16 by the lower end positioning portion in the outer peripheral surface 72 based on the pressing force, the flanges 28,30 and the element peripheral portion 26 sandwiched therebetween are elastically pressed to shrink by the pressing force, whereby the case 16 and the cap 22 are fastened by a simple operation of only fitting the first column-like portion 68 in the recesses 54,60 of the hooks 36,38 and turning the same. Since there is a space between the flanges 28,30 in this fastened state, even if there is a manufacturing error in the thickness or the like of the flange 30, the error is absorbed by elastic deformation of the element peripheral portion 26, and a sealed state can be positively obtained.

In turning the hook rod 40 for fastening, a fulcrum of the first column-like portion 68 to be turned is on the axis center and its point of force-application is on the extreme end of the second column-like portion 70 a distance L1 away from the fulcrum. The working point (load point) is on the peripheral surface 72 of the first column-like portion 68 a distance L2 away from the axis center, therefore, the distance L1 can be set relatively large to the distance L2 regardless of the thickness dimensions of the flanges 28,30 and the element peripheral portion 26. Thus, a required force for turning the hook rod 40, or assemble load for fastening to be defined by the above ratio L2/L1 may be relatively small. Incidentally, as clear from the above description, in this embodiment, a part to be fitted in the hook 36 in the first column-like portion 68, the outer peripheral surface 72 and the flat surface 74*a*, the outer peripheral surface 72 and the flat surface 74*b*, and the column-like portion 70 correspond to the second engaging portion, the second sliding contact surface, peripheral portion pressing surface and an operating part, respectively.

Moreover, in a state where a turning is completed as shown by a solid line in FIG. 3, that is a fastened state, the flat surface 74*a* comes in contact with the lower surface 50 of the hook 36, and the diameter of the first column-like portion 68 provided with the flat surface 74 at the side of the longer diameter is the largest at the ridge of the boundary between the curved portion of the outer peripheral surface 72 and the flat surface 74. Therefore, the pressing force applied from the lower surface 50 to the outer peripheral surface 72 based on the gap between the diameter of the contacting portion and the space A becomes larger as it turns to the right, that is, in the loosening direction, in the range of turning angles from the position as shown by a solid line in the drawing to the highest position of the ridge of the above boundary. Therefore, in order to turn the first column-like portion 68 to the right from the position shown in FIG. 3 it is required to overcome a larger pressing force than in the fastened state in the drawing. Slight turning of the first column-like portion 68 increases pressing force, whereby turning force occurs in the direction of returning to the fastened state as shown in the drawing, therefore, turning of the hook rod 40 and further unfastening due to external causes such as vibration are preferably controlled.

In this embodiment, the hook 38 corresponding to a third engaging portion is provided to the cap 22 in addition to the hook 36 on the side of the case 16. In fastening the case 16 and the cap 22, the hook 38 is fitted in a part positioned opposite to the hook 36 in relation to the second column-like portion 70 in the first column-like portion 68. Therefore, in the fastened state where pressing force is applied to the first column-like portion 68 from the lower surface 50 of the hook 36 and repulsive force is applied from the upper surface 46 of the flange 30 to the first column-like portion 68, the repulsive force applied from a flange upper surface 46 pushes up one of ends at the side of the hook 38 of the first column-like portion 68, and inclination of the first column-like portion 68 and further the other end are preferably inhibited from coming off from the hook 36. In other words, the hook 38 functions as a device to control such an inclination of the first column-like portion 68 of the hook rod 40. Such a function to control the inclination can be obtained by contacting the outer peripheral surface 74 of the first column-like portion 68 with either the lower surface 58 of the hook 38 or the upper surface 52 of the hook 36, therefore, a constitution in which at least one of the lower surface 58 and the upper surface 52 comes in contact with the outer peripheral surface 74 in a fastened state is sufficient.

Moreover, in this embodiment, the hooks 36,38 have a configuration of a hook having a right end portion open in FIG. 3. Therefore, the first column-like portion 68 of the hook rod 40 can be easily fitted in between the lower surface 50 of the hook 36 and the upper surface 46 of the flange 30 from the opening side. Thus, the fastening operation becomes further easier.

Next, another embodiment of the invention will be described. Incidentally, in the following embodiments, description regarding a common part to the following embodiments and the previous embodiment will be omitted with the same reference numerals.

Figure 6:
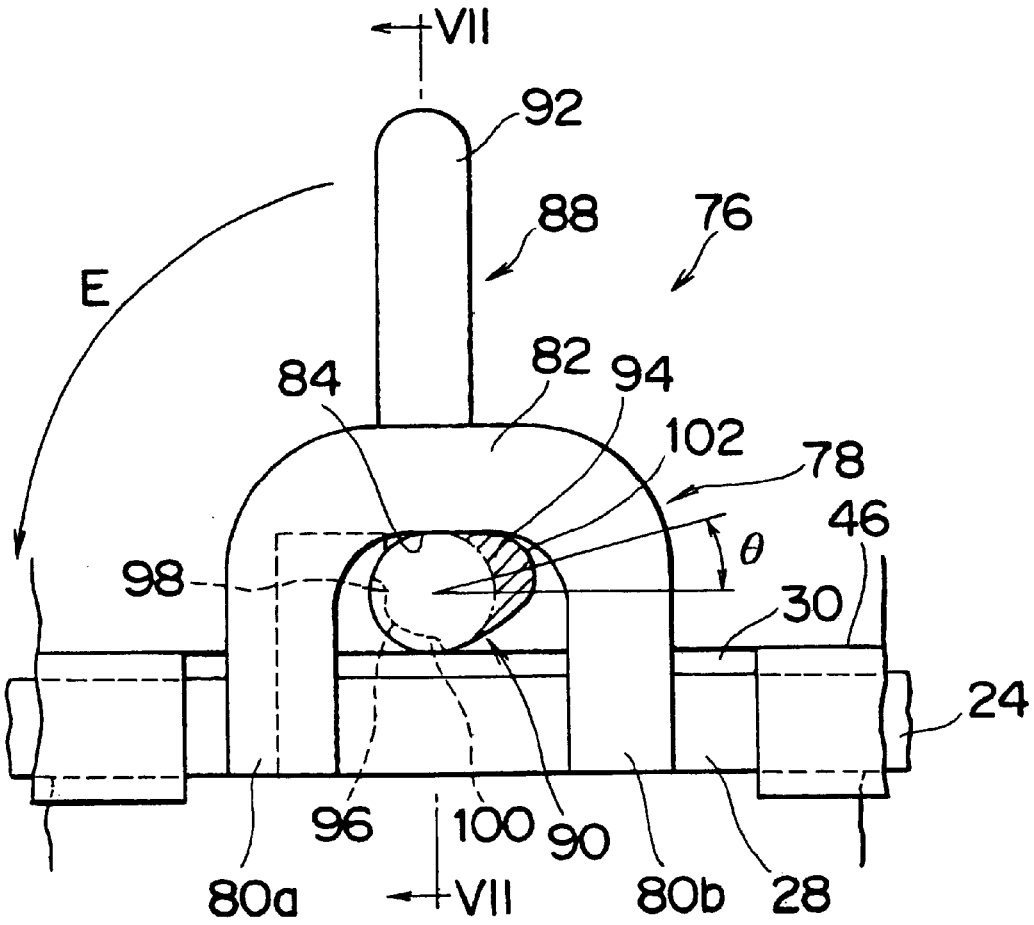
FIG. 6 is a view corresponding to FIG. 3 for explaining the constitution of a fastening device according to another embodiment of the invention.
Figure 7:
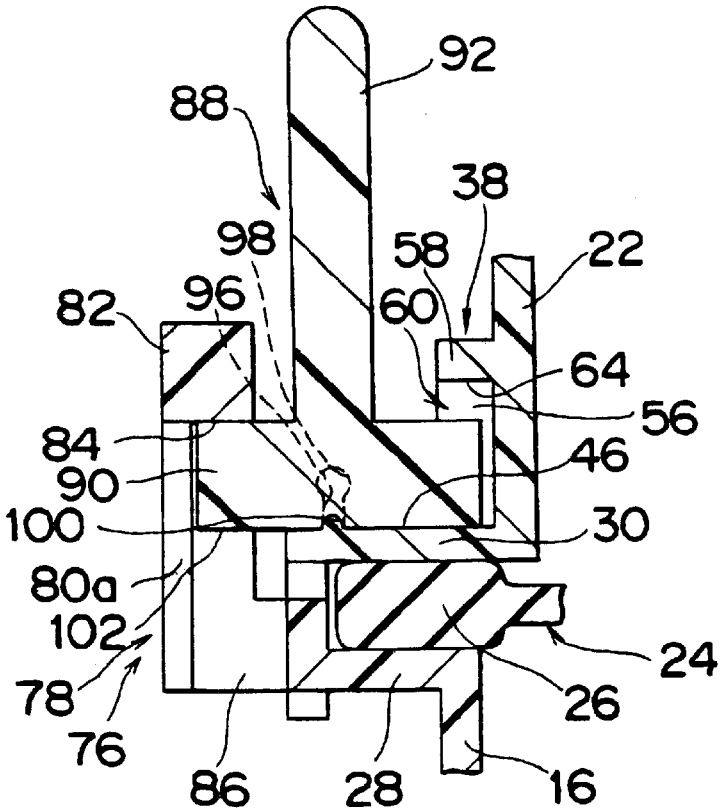
FIG. 7 is a sectional view viewed along line VII—VII of FIG. 6.
Figure 8:
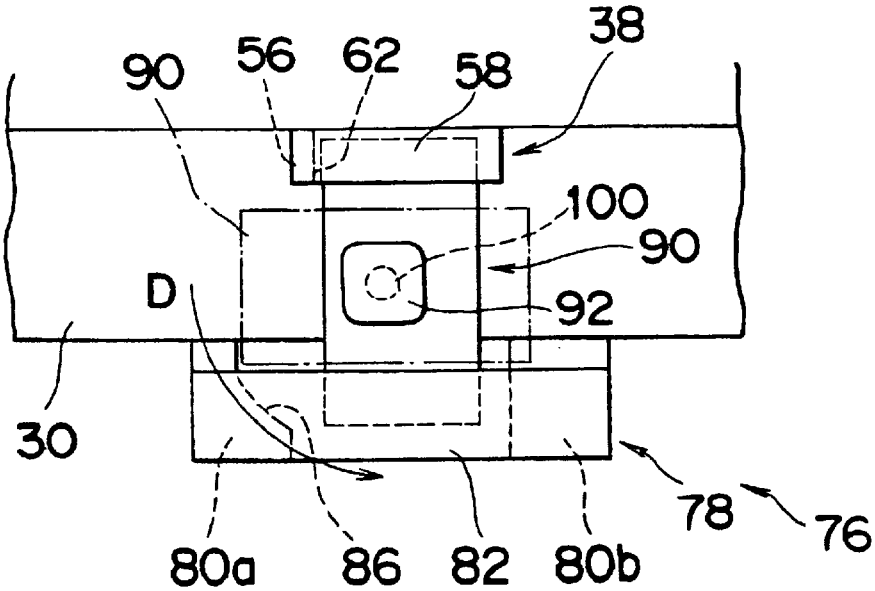
FIG. 8 is a plan view of the fastening device of FIG. 6.

FIG. 6 to FIG. 8 is drawings corresponding to FIG. 3, FIG. 5 and FIG. 4 of the previously-mentioned embodiment for explaining the essence in a constitution of another fastening device 76 capable of being employed in place of previously-mentioned fastening device 34. A case 16 and a cap 22 are put together with an element 24 inserted therebetween, however, FIG. 6 to FIG. 8 show a state where the flanges 28,30 are not pressed in the fastening device 76, that is, they are unfastened. In FIG. 6 to FIG. 8 a hook 78 continuing to the flange 28 is provided to project from the opening end to the side of the cap 22 at the side surface of the case 16. The hook 78 comprises a pair of first parts 80*a*,80*b* extending to the side of the cap 22 from the flange 28 and a second part 82 provided between their upper ends positioned at a side upper than an upper surface 46 of the flange 30 (that is, the side apart from the case 16). Therefore, in a front view shown in FIG. 6, the hook 78 has a reversed U-shape entirely in a front view shown in FIG. 6, and a lower surface 84 facing to the side of the flange 30 of the second part 82 is substantially parallel to the upper surface 46. Moreover one first part 80*a* with removed ridged part between one surface on the side of the flange 30 and one surface on the side of the other first part 80*b* where a cylindrical recessed surface 86 is provided in the direction of the axis center extending along the vertical direction to the paper surface in FIG. 8.

Moreover, the hook 38 at the opposite position to the hook 78 is provided at the side surface of the cap 22. The hook 38 is constituted in a substantially similar shape to that provided at the previously-mentioned fastening device 34. However, in an unfastened state as shown in FIG. 7, a lower surface 64 of the second part 58 is positioned somewhat higher than the lower surface 84 of the second part 82 of the hook 78.

Moreover, a hook rod 88 to be fitted in the hooks 78, 38 is constituted by a first column-like portion 90 having a substantially egg-shape in cross section and a second column-like portion 92 extending vertically from the center part in the direction of the axis center, having the shape of a substantially circle or a chamfered square in cross section. The position relationships of the first column-like potion 90 and the second column-like potion 92 are such that the center of the circular sectional part at the inner periphery side of the arch of the first column-like portion 90 shown by dot-dash lines in FIG. 6 is positioned on a straight line passing the axial center of the second column-like portion 92. Moreover, in the unfastened state shown in the drawing, the second column-like portion 92 is substantially vertical to the upper surface 46 of the flange 30. However, in the vertical state, a line connecting a center of the above mentioned circular sectional part and the vertex of a shaded part shown in an enlarged drawing at the outer periphery side from the dot-dash lines (nose) 94 is ahead of the turning direction to the left at an angle θ to the upper surface 46.

A guide groove 96 is provided to the central outer peripheral surface in the direction of axis-center of the first column-like portion 90, along the periphery direction. The guide groove 96 is formed in the range of about 90° from the lower end position in the drawing with a larger diameter than width of the guide groove 96 at the end in the right-turning direction and has a depression 98 of a hemisphere-shape deeper than the depth of the groove. The depression 98 is formed in a size corresponding to the size of a protrusion 100 in the shape of a hemisphere provided to the upper surface 46 of the flange 30. In other words, the protrusion 100 is in the size to enter the guide groove 96 at its extreme end and to enter the depression 98 as the entirety.

When the case 16 and the cap 22 are fastened by the fastening device 76 constituted as the foregoing, they are put together so as to have a cross section as shown in FIG. 7, and then the hook rod 88 is inserted between the hooks 78,38 in which the direction of the axis center of the first column-like portion 90 is parallel to the upper surface 46 of the flange 30 and along the longitudinal direction as shown by the dot-dash lines in FIG. 8 at the position where the axial center of the second column-like portion 92 correspond to the axis center of the protrusion 100 in the direction vertical to the upper surface 46. At this time, the protrusion 100 is fitted in the guide groove 96 at its extreme ends. Incidentally, in this stage, since the entirety of the protrusion 100 does not enter the guide groove 96, the first column-like portion 90 is positioned slightly apart from the upper surface 46.

Next, the hook rod 88 is turned to the axis center of the second column-like portion 92 to the left direction as shown by an arrow D in FIG. 8 by 90°. Whereby, as shown by a solid line in FIG. 8, one end of the first column-like portion 90 and the other end are inserted into the hook 78 and the hook 38, respectively. At this time, since the cylindrical recessed surface 86 is provided to the first part 80*a* of the hook 78 by removing a ridge portion at the side of the protrusion 100, the first column-like portion 90 does not interfere with the first part 80*a* during turning Moreover, since movement of the first column-like portion 90 in the direction along the upper surface 46 by engagement of the guide groove 96 and the protrusion 100 is controlled, the first column-like portion 90 and the hooks 78,38 are positioned in the predetermined relationship of position when the turning is completed.

Then, the second column-like portion 92 is turned by about 90° to the direction of an arrow E as shown in FIG. 6 to the axis center of the circular sectional part of the first column-like portion 90 as shown in FIG. 6 along the side wall surface of the cap 22. In the process of turning, the diameter in the vertical direction facing to the lower surface 84 of the hook 78 from the turning center of the first column-like portion 90 having a substantially egg-shaped in cross section increases from the diameter at the time of inserting to the hook 78 as it turns, therefore, pressing force which becomes larger as a turning angle gets larger is applied to an outer peripheral surface 102 of the first column-like portion 90 from the lower surface 84. That is, in this embodiment, the substantially egg-shaped outer peripheral surface 102 functions as a cum surface. Therefore, based on the pressing force the upper surface 46 of the flange 30 is pressed to the flange 28 of the case 16 by a part positioned at the lower end in the outer peripheral surface 102 and based on the pressing force the flanges 28,30 and based on that pressing force the element peripheral portion 26 sandwiched therebetween are elastically pressed to shrink. Whereby the case 16 and the cap 22 are fastened by a simple operation of fitting the first column-like portion 90 in the hooks 78,38 and turning.

In the above-mentioned fastened state where the hook rod 88 is turned by as much as 90°, the extreme end positioned at the outermost outer periphery side from the turning axis of the outer peripheral surface 102 in the substantially egg-shape further turned by the angle θ to the left direction from the contacting position with the lower surface 84 in the drawing. Therefore, since the distance to the outer peripheral surface 102 from the turning center at a contacting position with the lower surface 84 in the position where the fastening is completed becomes smaller than its largest value, when turned in the opposite direction to the arrow E direction, pressing force applied to the outer peripheral surface 102 from the lower surface 84 increases as it turns in the beginning of the turning, and turning force in the arrow E direction that is in the fastening direction is applied to the first column like portion 90 based on the pressing force. Therefore, in the structure of this embodiment, unfastening due to vibration or the like during use is preferably controlled.

In turning in the direction of the arrow E as above, a state where an extreme of protrusion 100 of the flange upper surface 46 is fitted in the guide groove 96 of the first column-like portion 90 is maintained. Thus, even if pressing force is applied to the first column-like portion 90 from the hook 78 with the turning there is no such a case that slanting of the hook rod 88 position caused by that makes the fastening work difficult or unfastening occurs easily. At the position where turning is completed, the entirety of the protrusion 100 is fitted in the depression 98 provided at the extreme end of the guide groove 96, whereby the outer peripheral surface 102 of the first column-like portion 90 becomes to contact with the flange upper surface 46. Therefore, since it is necessary for turning from the fastened state in the loosening direction that the engaged state of the protrusion 100 and the depression 98 is released and the outer peripheral surface 102 becomes apart from the flange upper surface 46, pressing force applied to the outer peripheral surface 102 from the lower surface 84 of the hook 78 in the beginning of the turning in the unfastening direction increases further. In this embodiment, unfastening is further controlled also by such an engagement of the protrusion 100 and the depression 98.

Figure 9:
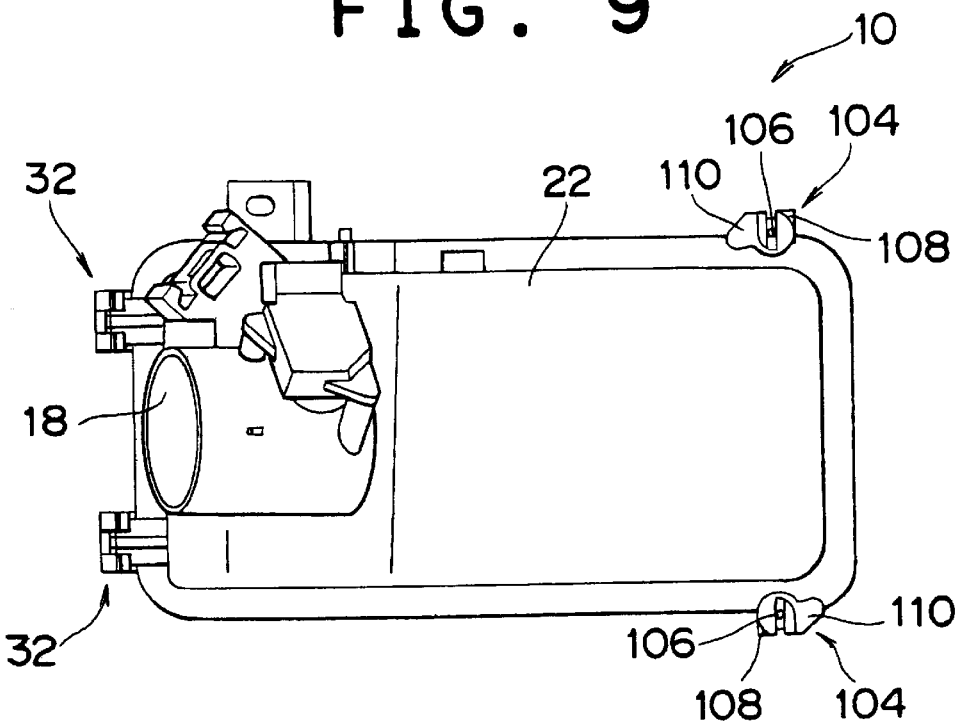
FIG. 9 is a plan view showing the entirety of an air cleaner apparatus provided with a fastening device according to still another embodiment of the invention.
Figure 10:
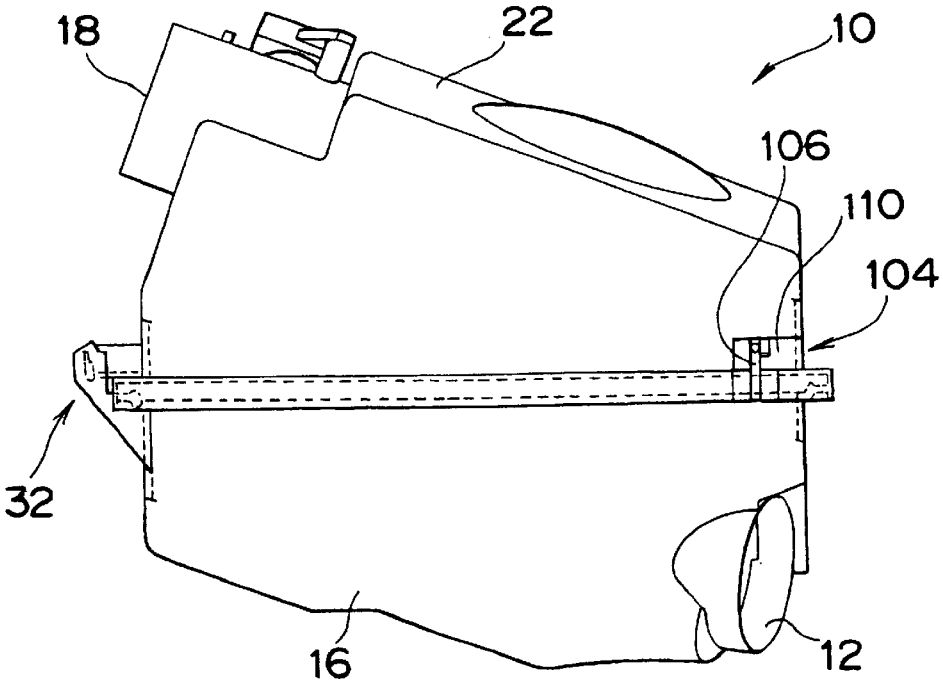
FIG. 10 is a front view of the air cleaner apparatus of FIG. 9.
Figure 11A:
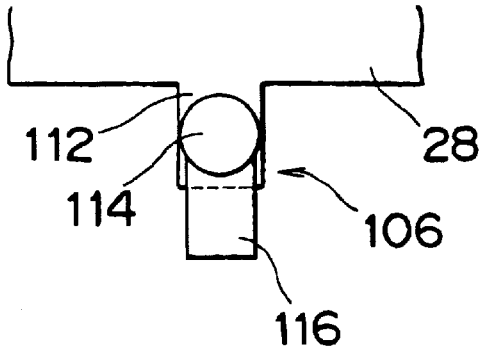
FIG. 11A, FIG. 11B and FIG. 11C are a plan view, a front view and a view from below, respectively, for explaining the constituent hook rod in the fastening device which is provided to the air cleaner apparatus of FIG. 9.
Figure 11B:
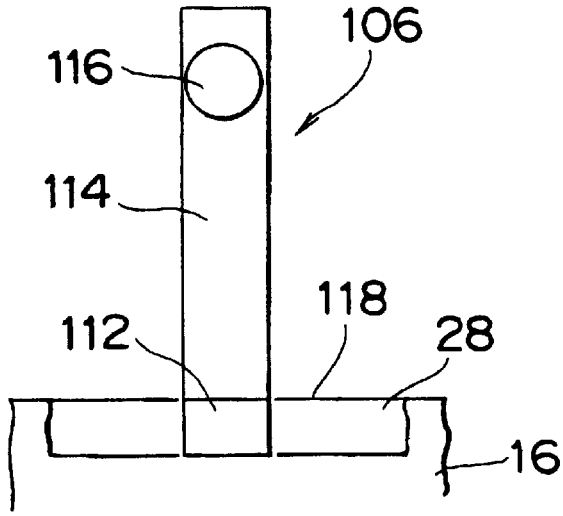
Figure 11C:
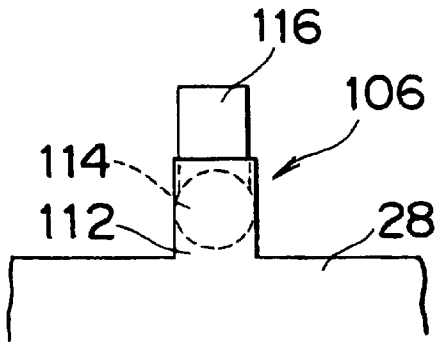

FIG. 9 and FIG. 10 are a plan view and a front view showing the entirety of an air cleaner apparatus 10 provided with a fastening device 104 of still another embodiment, respectively. In this embodiment, the fastening device 104 is constituted by a hook rod 106 formed to be integrated with the case 16, a hook rod inserting portion 108 formed to be integrated with the cap 22 and a clamp (fastening part) 110 being independent from them. As a plan view, a front view and a view from below are shown in FIG. 11A, FIG. 11B and FIG. 11C, respectively, the hook rod 106 is provided with a base portion 112, an axial portion 114 and a protrusion 116. The base portion 112 is formed to project outwardly from the flange 28 of the case 16, having a square-shap in plan surface. The thickness of the base portion 112 is the thickness of the flange 28. The axial portion 114 has a column-like shape formed to project from the base portion 112 in the direction of axis center vertical to the upper surface of the base portion. The protrusion 116 is formed to project in the diametric direction from the side surface of the axial portion in the adjacent of the extreme end of the axial portion 114 in a column like shape. The protrusion 116 is provided with an axis at right angles to the axis center of the axial portion 114. Its projecting direction is as same as the direction of the base portion 112 projects from flange 28, that is parallel to the upper surface 118 of the flange 28 and vertical to its edge. Such a hook rod 106 may be constituted of resin injected to a gate by providing the gate to which resin is injected in the vertical direction to the flange 28, for example, in an injection molding of the case 16. In case of such a molding constitution, a hook rod 106 of a sufficiently thick diameter can be easily obtained.

Figure 12A:
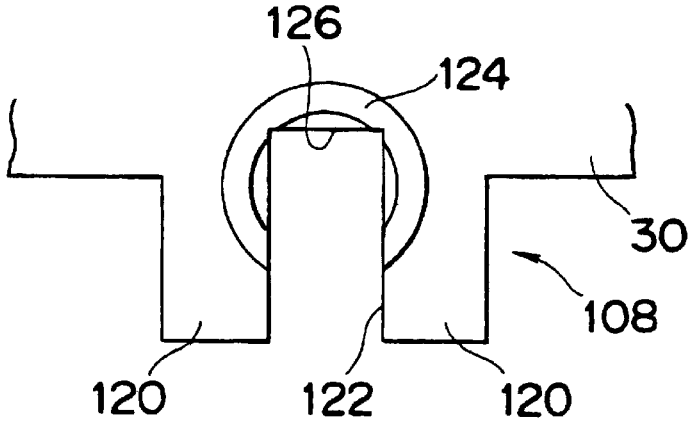
FIG. 12A, FIG. 12B and FIG. 12C are a plan view, a front view and a view from below, respectively, for explaining the constituent hook rod inserting part in the fastening device which is provided to the air cleaner apparatus of FIG. 9.
Figure 12B:
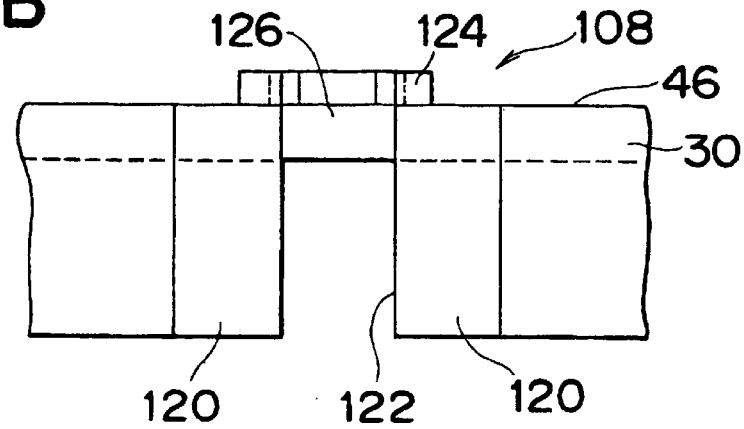
Figure 12C:
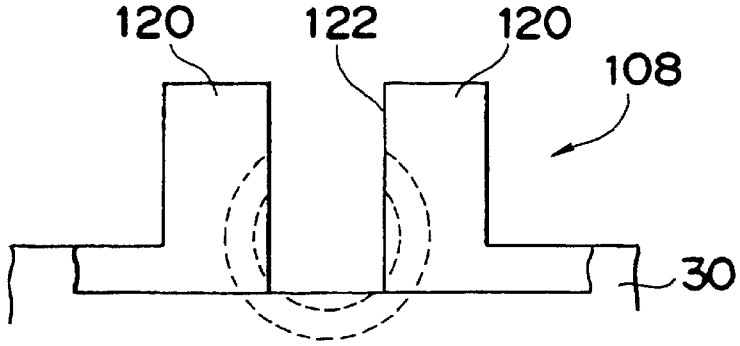
Figure 13A:
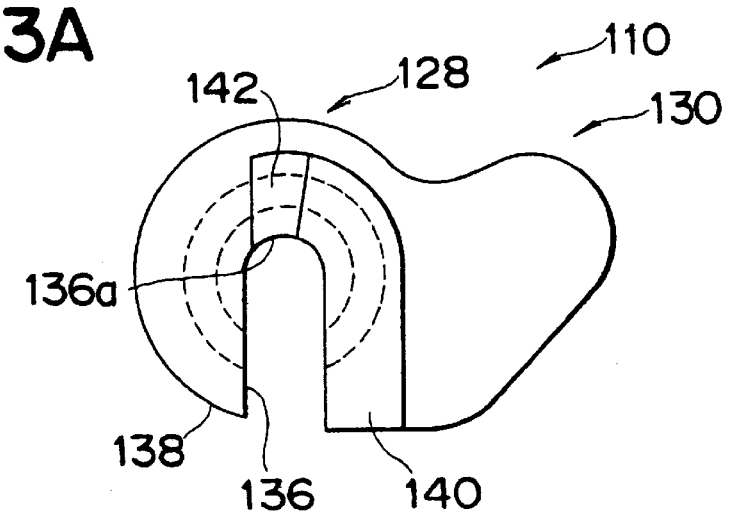
FIG. 13A, FIG. 13B and FIG. 13C are a plan view, a front view and a view from below, respectively, for explaining the constituent clamp in the fastening device which is provided to the air cleaner apparatus of FIG. 9.
Figure 13B:
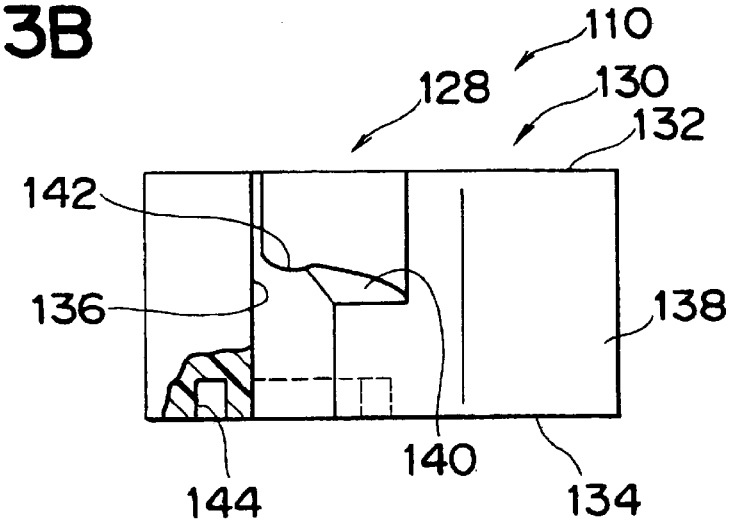
Figure 13C:
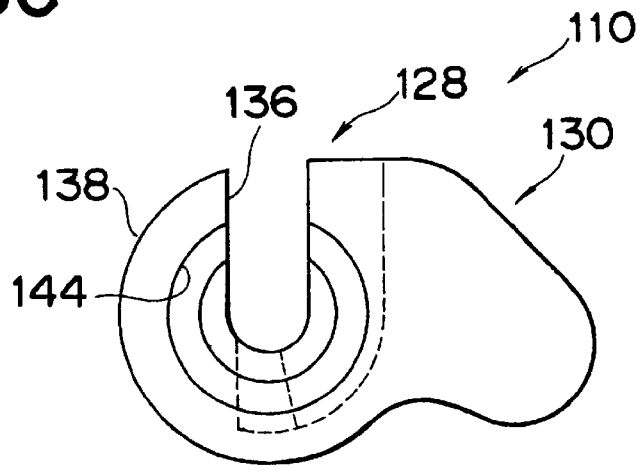

Moreover, the hook rod inserting portion 108 is provided with a pair of projecting portions 120, a concave 122 and a protrusion 124 as a plan view, a front view and a view from below are shown in FIG. 12A, FIG. 12B and FIG. 12C, respectively. The pair of projecting portions 120 are formed to project outward from a flange 30 having a rectangular shape in cross section in the cap 22 and having a plan shape of square. The height of the projecting portion 120 is similar in size to that of the flange 30. A concave U-spaced wall 122 is formed between the projecting portions 120,120. The protrusion 124 is provided at a position surrounding the concave 122 of the flange upper surface 46 in the shape of semicircle. The concave wall 122 has an opening width size sufficiently larger than the diameter of the hook rod 106, and an inner surface at the inner side of the concave wall 122 is positioned at the inner side from the edge of the flange 30 and provided with a portion sagging downward in the flange 30 in the concave wall 122. As a plan view, a front view and a view from below are shown in FIG. 13A, FIG. 13B and FIG. 13C, respectively, the clamp 110 having a part in the periphery direction in the shape of plan surface which becomes hollow to the central portion and another part being in a considerably enlarged shape. The clamp 110 is a column-like body comprising an engaging portion 128 including the hollow part and an operating part 130 constituted by an enlarged part in the periphery direction. Incidentally, the clamp 110 has upper and lower surfaces 132,134 being parallel to each other. The clamp 110 is made of similar resin material to that of the case 16 and the cap 22.

A recess 136 formed by the above-mentioned hollow provided to the engaging portion 128 bored through upper and lower surfaces 132,134, and the internal wall surface of the innermost part is formed to a cylindrical recessed surface 136*a*. The size of the opening width at the side surface 138 is as much as slightly larger than the diameter of the axial portion 114 of the hook rod 106 at the side of the lower surface 134. The recess 136 has an opening width enlarged to a size substantially two times as large as the intermediate portion in the height direction in the range of the upper surface 132 side. A protrusion support surface 140 provided to the enlarged portion for supporting the protrusion 116 of the hook rod 106 at the time of the fastening operation as will be described later. The protrusion support surface 140 is a smoothly inclined surface at substantially regular inclining angles so as to incline to approach the upper surface 132 as approaching the inner peripheral portion from the side of a side surface 138 in a substantially regular width size. However, a cavity 142 is provided at the end positioned at inner part of the cylindrical recessed surface 136a in the inner periphery side of the inclined surface. Therefore, the height from the lower surface 134 is positioned slightly lower than the proximate portion of where the inclined surface reaches the cavity from the side surface 138.

Moreover, a groove 144 in the shape of semicircle is provided to the lower surface 134 of the engaging portion 128 at the peripheral portion of the cylindrical recessed surface 136*a*. The semicircle-shaped groove 144 is to be fitted in by the semicircle-shaped protrusion 124 as will be described later. The semicircle-shaped groove 144 has a width slightly larger than the width in the diametric direction of the semicircle-shaped protrusion 124 and the depth slightly larger than the height in size.

Figure 14A:
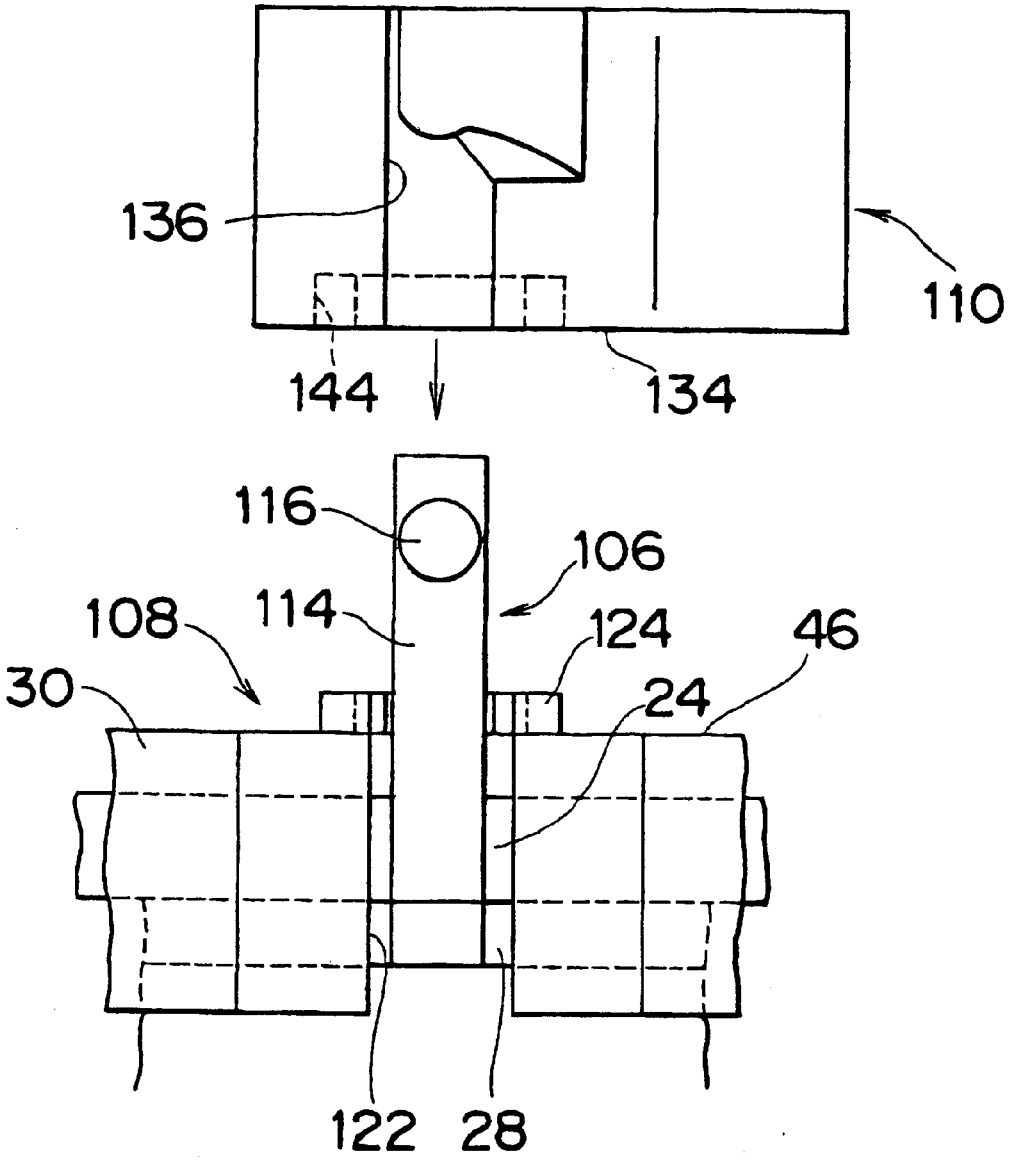
FIG. 14A and FIG. 14B are a plan view and a front view, respectively, for explaining a fastening operation by means of the fastening device which is provided to the air cleaner apparatus as shown in FIG. 9.

In fastening of the case 16 and the cap 22 by the fastening device 104 constituted by each member through the filter element 24 as the foregoing, first, they are put together in such a manner that the hook rod 106 is inserted in the recess 122 of the hook rod inserting portion 108. In such a placed state the axis center in the axial portion 114 of the hook rod 106 corresponds to the axis center of a semicircular protrusion 124. FIG. 14A shows the time of being placed on over the other as such, about half of the entire length of the hook rod 106 is positioned at the upper side of the flange 30. The protrusion 116 is positioned at the opposite side to the flange 28 in relation to the flange 30 sufficiently upwardly apart from the flange upper side 46 and the semicircular protrusion 124.

Figure 14B:
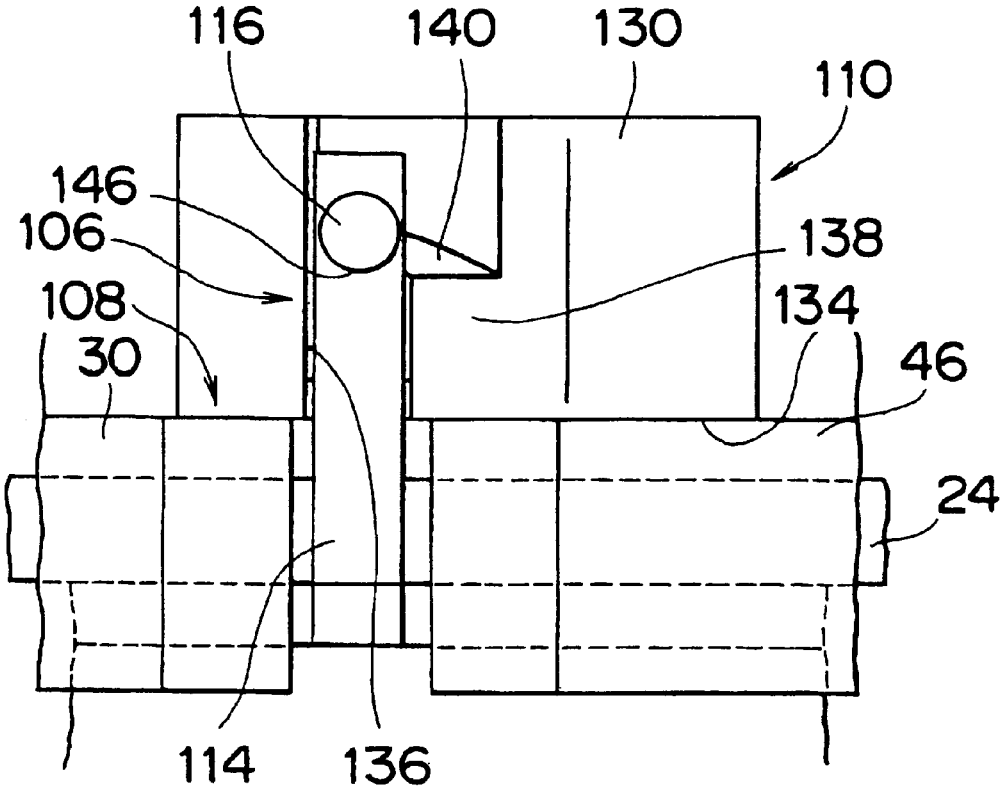

In a successive stage as shown by the arrow in above FIG. 14A the hook rod 106 is fitted in the clamp 110 from its extreme end. FIG. 14B shows the fitting stage. At this time, in the clamp 110 the axis center of the semicircular groove 144 provided to the lower surface 134 corresponds to the axis center of the axial part 114 to fit the semicircular protrusion 124 in the semicircular groove 144. Thereby, a clamp lower surface 134 comes closely contact with the flange upper surface 46, and the recess 136 accommodates substantially entirety of the portion projecting upper from the upper surface 46 of the flange 30 in the hook rod 106. Moreover, the protrusion 116 of the hook rod 106 is positioned slightly higher than the height position at the side end portion in the side surface 138 of the protrusion support surface 140.

Figure 15:
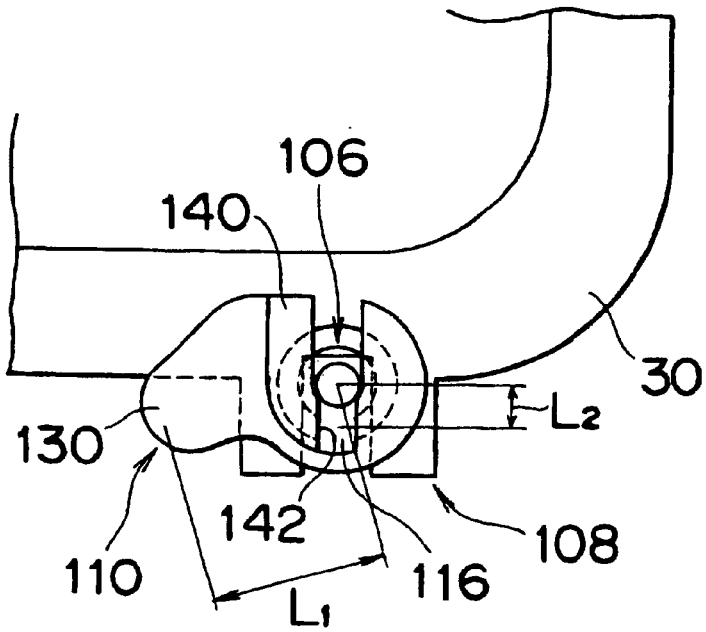
FIG. 15 is a plan view explaining a state where the fastening operation of FIG. 14 has been completed.

After the hook rod 106 is fitted in the clamp 110 as mentioned above the operating part 130 is grabbed to turn around axis center of the hook rod 106 in the right direction from the plan view, while pressing the clamp 110 toward the flange 30. At the time of slightly turning the operating part 130, the protrusion support surface 140 of the clamp 110 is positioned at the lower side of the protrusion 116 of the hook rod 106 in a non-contact state. By further turning the operating part 130 the protrusion support surface 140 being inclined apart from the lower surface 134 comes in contact with the lower surface of the protrusion 116 as approaching the inner periphery side and the protrusion 116 pushes down the protrusion support surface 140 toward the flange upper surface 46. At the time of turning the operating part 130, since the semicircular protrusion 124 is fitted in the semicircular groove 144 and the turning axis center corresponds to the axis center of the protrusion 124 and the groove 144, the groove 144 is guided to the protrusion 124, thereby the clamp 110 is turned without slanting the position in the surface direction of the upper surface 46 of the flange 30. While the protrusion support surface 140 slides to be in contact with the outer peripheral surface lower end 146 of the protrusion 116, the clamp 110 is turned, whereby the protrusion 116 is guided relatively apart from the flange 30 by the protrusion support surface 140 whose height gradually increases. Moreover, pressing force gradually increasing according to the height of the protrusion support surface 140 is applied to the upper surface 46 of the flange 30 through the lower surface 134 of the clamp 110 from the protrusion 116. Therefore, the flange 30 is pressed by the flange 28 through the element peripheral portion 26, which are secured in the pressing state. FIG. 15 shows a fastened state of being turned to the right direction by about 180° from the beginning position where the clamp 110 is fitted in with the hook rod 106 as described above. In the turning operation for fastening the axis center of the axial part 114, the operating part 130 and the protrusion become the fulcrum, the point of force-application and the working point, respectively. Therefore, as shown in the drawing, both of a distance L1 between the fulcrum and the point of force-application and a distance L2 between the fulcrum and the working point are set regardless of the thickness of the flanges 28,30 and so on, and L1 sufficiently increases compared to L2. Therefore, in this embodiment, the assembly load can be reduced without particularly complicated constitution. Incidentally in this embodiment, the operating part 130 is to project to the outer periphery side of the flanges 28,30 in turning of the clamp 110. Although the long length of the operating part 130 is not preferable, the distance L2 between the fulcrum and the working point becomes extremely small as clear from above FIG. 15, therefore, a function as a force increasing device can be adequately obtained with a relatively small L1 between the fulcrum and the point of force-application. In this embodiment, the hook rod 106, the outer peripheral surface lower end 146 of the protrusion 116, the engaging part 128 of the clamp 110, the protrusion support surface 140 and the lower surface 134 of the clamp 110 correspond to the first engaging part, the first sliding contact surface, the second engaging part, the second sliding contact surface and the peripheral portion pressing surface, respectively.

Moreover, in the fastened state shown in above FIG. 15, the protrusion 116 of the hook rod 106 is being fitted in a depression 142 provided to the inner periphery side ends of the protrusion support surface 140, in a case where the fastened state is released by turning the clamp 110 in the loosening direction of the left turning in FIG. 15, it is necessary to push down the upper surface 46 by pressing the flange 30 with larger pressing force than that in the fastened state for removing the protrusion 116 from the depression 142. Accordingly, when the clamp 110 turns slightly in the loosening direction due to vibration and so on during use of the air cleaner apparatus 10, turning force in the fastening direction is applied by pressing force increasing until going over the boundary with the protrusion support surface 140 at a higher position than the depression, thereby unfastening is preferably controlled in this embodiment. Incidentally above-mentioned FIG. 9 and FIG. 10 show the unfastened state where the clamp 110 is only mounted on the flange 30 as shown in FIG. 14B.

Figure 16:
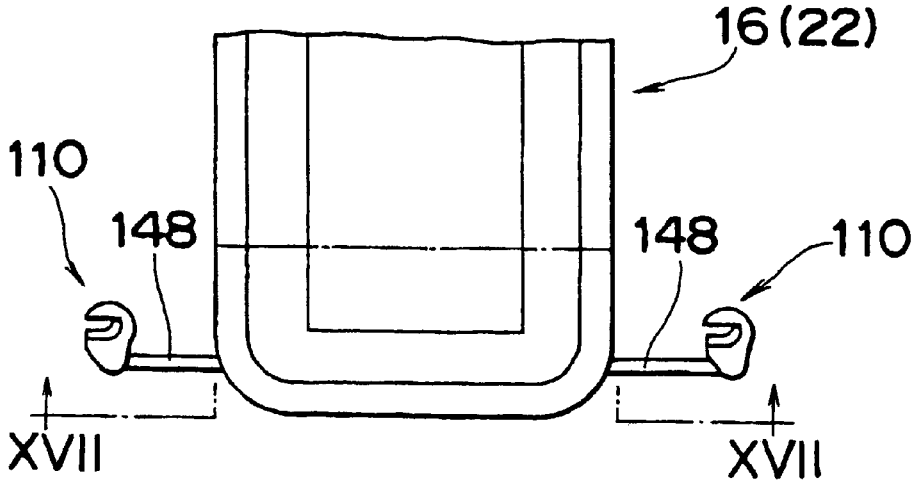
FIG. 16 is an explanatory view of a molding form of a case or a cap in the air cleaner apparatus of FIG. 9.
Figure 17:
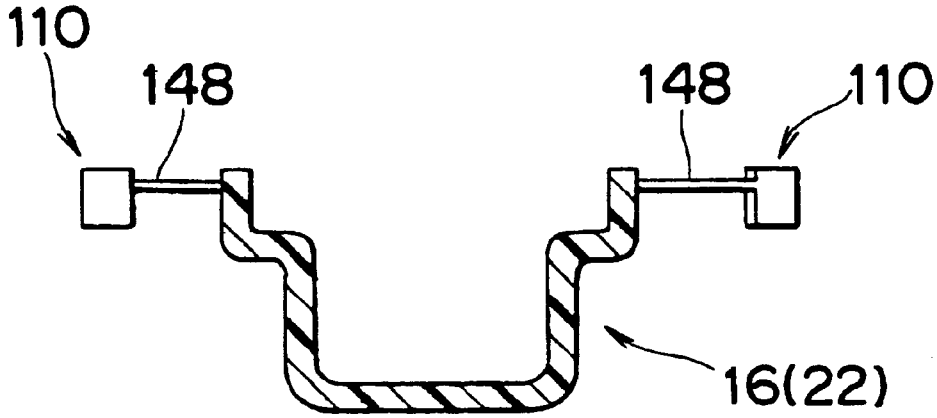
FIG. 17 is a sectional view viewed along line XVH—XVH of FIG. 16.

Now that, as mentioned above, all of the case 16, the cap 22, and the clamp 110 are made of similar resin material and manufactured by injecting molding. FIG. 16 is a plan view showing essence of the case 16 or cap 22, which is molded, and FIG. 17 shows a cross sectional viewed on line XVH—XVH in FIG. 16. A cavity for molding the clamp 110 is integrally formed to a part of a mold of the case 16 or the cap 22 which is not shown. The cavities of the case 16 or the cap 22 and the clamp 110 are connected through a gate for resin injection. Therefore, as shown in the drawing, the case 16 or the cap 22 and the clamp 110 which are molded are connected by a connecting part 148 derived from the gate and integrated. Thus, since it is not necessary to prepare a separate mold for molding the clamp 110, a cost of molds can be saved, and the clamp 110 can be adequately prevented from being lost by maintaining the connected state of the clamp 110 by the connecting part 148 at least until an air cleaner apparatus 10 is assembled at the assembly site where the clamp 110 is removed. Incidentally, if there is no trouble in the fastening operation, the clamp 110 can be prevented from being lost also at the time of exchanging elements by maintaining the state where the clamp 110 is connected with the case 16 and the cap 22 by the connecting part 148.

Figure 18A:
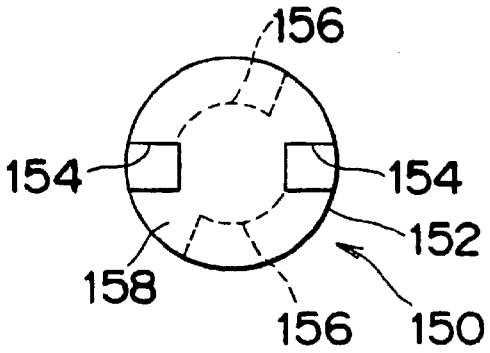
FIG. 18A and FIG. 18B are a plan view and a front view of a constituent hook rod in a fastening device according to still another embodiment of the invention, respectively.
Figure 18B:
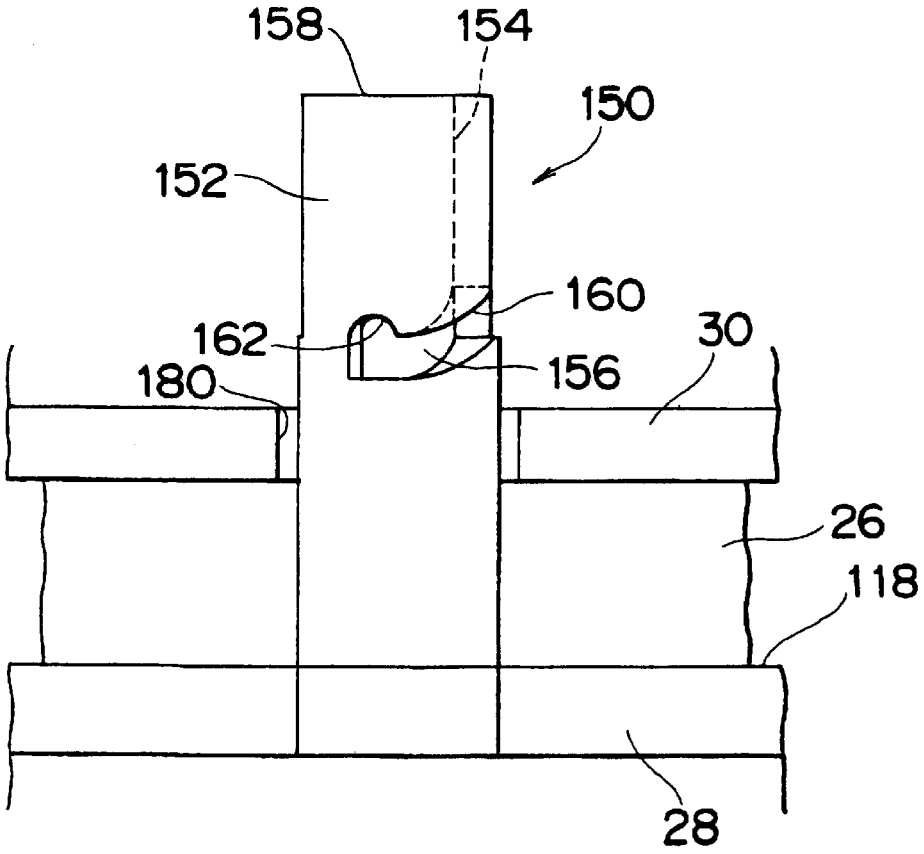
Figure 19A:
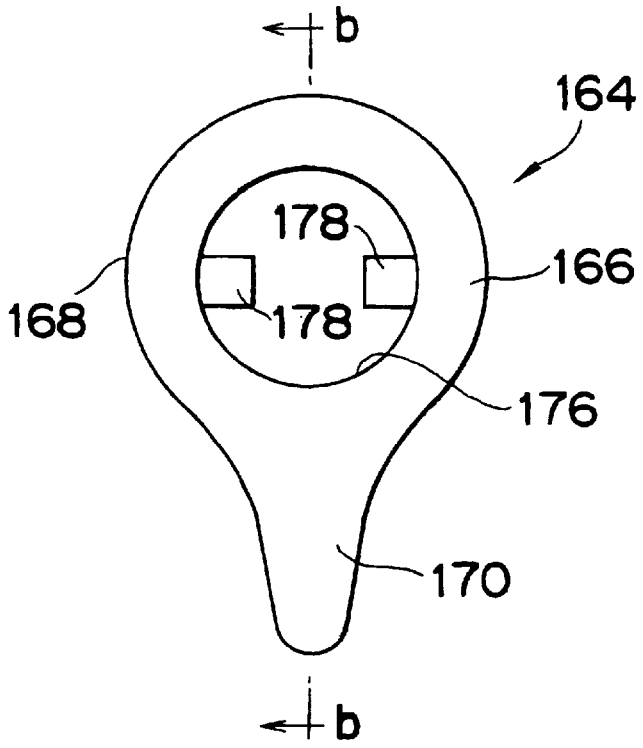
FIG. 19A is a plan view showing a clamp to constitute a fastening device in combination with the hook rod of FIG. 18.
Figure 19B:
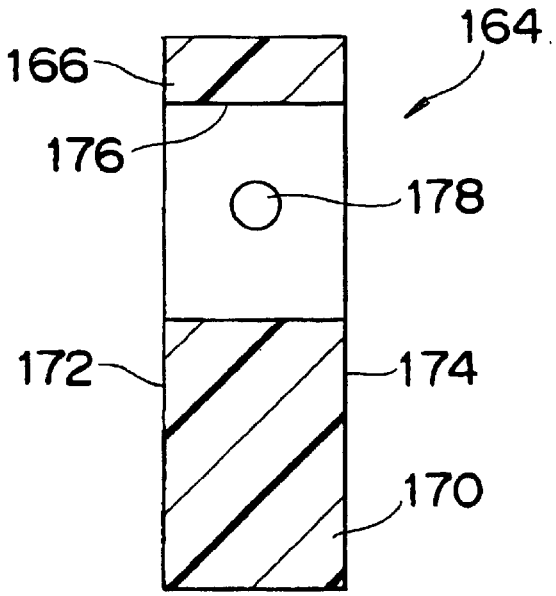
FIG. 19B is a sectional view viewed along line XIXB—XIXB of FIG. 19A.
Figure 20:
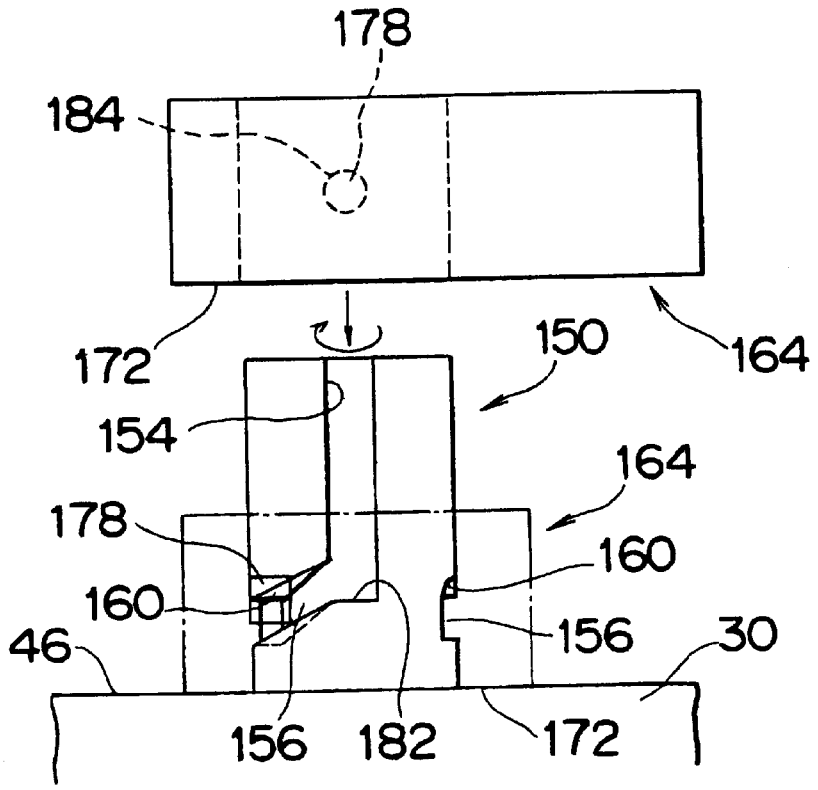
FIG. 20 is an explanatory view of a fastening method by means of the fastening device shown in FIG. 18 and FIG. 19.
Figure 21:
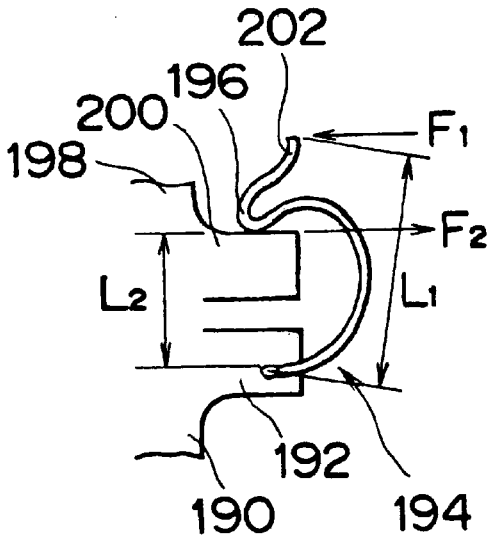
FIG. 21 Related Art
FIG. 21 is a view explaining problems of the fastening structure with the conventional clamp.

FIG. 18 to FIG. 20 are explanatory views of still another fastening structure; FIG. 18B is a front view showing a hook rod 150 to be employed in the fastening structure in a placing over state for fastening the case 16 and the cap 22, and FIG. 18A is a plan view of the hook rod 150. The hook rod 150 is integrally formed to project from the flange 28 of the case 16 in the vertical direction to the upper surface 118. In fastening the extreme end of the hook rod 150 is positioned upper than the flange 30 of the cap 22. The outer peripheral surface 152 is provided with a pair of protrusion inserting grooves 154 and a pair of protrusion engaging grooves 156 at two symmetrical positions respectively in the periphery direction to an extent of projection above the flange 30. Incidentally, as required for explanation of the protrusion inserting grooves 154 and the protrusion engaging grooves 156, FIG. 18B shows only one for each.

The above-mentioned pair of protrusion inserting grooves 154 are provided in the direction substantially along the direction of the axis center of the hook rod 150 to an extent from the extreme end surface 158 to the intermediate part in the direction of the axis center. The above-mentioned pair of protrusion engaging grooves 156 are provided in the direction substantially along the peripheral direction of the hook rod 150 to an extent which is less than halfway round the periphery with its one end (base end) continuing to the lower end of the side of the flange 28 in the protrusion inserting groove 154. The inner wall surface 160 in a spiral shape at the side of the extreme end surface 158 approaches flange 28 as the protrusion engaging groove 156 becomes apart from the protrusion inserting groove 154, that is, as it directs to the end side in the peripheral direction from the base end of the protrusion engaging groove 156 connecting to the protrusion inserting groove 154. The protrusion engaging groove 156 tends to approach the flange 28 toward the end side as an entirety, the end side is provided with a depression 162 extending to a slight length toward the side of the extreme end surface 158. Therefore, the depression 162 is positioned at the side of the extreme end surface 158 compared to a part just before the inner wall surface 160 which approaches the flange 28 toward the end side. Incidentally, the protrusion engaging groove 156 has the depth in the diametric direction of the hook rod 150 and the width which are substantially same over the entire length from the base end of the extreme end surface 158 side of the protrusion inserting groove 154 to the depression 162, the end side provided with the depression 162 has a circular arch-shape of a substantially equal diameter to the other part.

Moreover, FIG. 19A is a plan view showing another constituent element of the fastening structure, a clamp 164 to be fitted in the hook rod 150; FIG. 19B is a sectional view viewed on line XIXB—XIXB of FIG. 19A. The clamp 164 is a part made of resin material which is similar to that of the case 16 and so on, comprising an engaging part 166 in a substantially annular configuration in the plan view and an operating part 170 integrally provided by enlarging a part of the outer peripheral surface 168 to the outer periphery side. The engaging part 166 and the operating part 170 have substantially equal thickness in size and upper and lower surfaces 172,174 parallel to each other. The substantially annular engaging part 166 has a hole bored through in the direction of thickness, that is a cylindrical inner peripheral surface 176 and a pair of column-shaped protrusions 178 formed to project at two symmetrical positions in the peripheral direction which are the center in the direction of the thickness. The pair of protrusions 178 in a similar size to each other are positioned to face to each other and their axis center directions are both facing to the radial direction of the inner peripheral surface 176. The diameter of the inner peripheral surface 176 is slightly larger than the diameter of the hook rod 150. Moreover, the length of the protrusion 178 is slightly shorter than the depth of the protrusion engaging groove 156 and so on. Its diameter is slightly smaller than the opening width of the protrusion engaging groove 156.

The fastening device constituted by the above mentioned hook rod 150 and the clamp 164 is used as follows. First, the case 16 and the cap 22 are put together as shown in FIG. 18B, whereby the clamp 164 is fitted from its extreme end in the hook rod 150 positioned in a square-shaped or circular arch-shaped notch 180 provided to the side of the flange 30 of the cap 22 or the flange 30 as shown in FIG. 20. At this time, the lower surface 172 becomes parallel to the upper surface 46 of the flange 30 and in a posture where the protrusion 178 positions on the protrusion inserting groove 154, for example when the protrusion inserting groove 154 is provided on a straight line along the longitudinal direction of the flange 30, the protrusion 178 is positioned on the straight line and the clamp 164 is fitted in the direction where the operating part 170 is substantially vertical to the edge of the flange 30.

Next, the clamp 164 is inserted to the position where the protrusion 178 contacts with the lower end surface 182 of the protrusion inserting groove 154, followed by grabbing the operation part 170 and turning the clamp 164 to the axis center of the hook rod 150 in the direction shown by the arrow of FIG. 20, that is the right direction in FIG. 18A. By this turning operation, the clamp 164 is turned while the protrusion 178 is guided in the protrusion engaging groove 156. Since the protrusion engaging groove 156 is inclined so as to approach the flange 30 toward the end side, the protrusion 178 guided toward the end side approaches the flange 30 as the turning angle gets larger. Therefore, an outer peripheral surface top end 184 of the protrusion 178 is pressed toward the flange 30 side by the upper inner wall surface 160 of the protrusion engaging groove 156, and further the clamp 164 is pressed toward the upper surface 46 of the flange 30, whereby the lower surface 172 presses the flange 30 toward the flange 28. In this embodiment, the upper inner wall surface 160, the outer peripheral surface top end 184 of the protrusion 178 and the lower surface 172 of the clamp 164 correspond to the first sliding contact surface, the second sliding contact surface and the peripheral end pressing surface, respectively. The fulcrum is the axis center of the hook rod 150; the point of force-application is the extreme end of the operating part 170; and the working point is the contact point of the protrusion 178 and the inner wall surface 160. Therefore, similarly to the case of previously-mentioned fastening device 104, a distance between the fulcrum and the point of force-application can be set sufficiently large compared to a distance between the fulcrum and the working point, which makes it possible to reduce the assembly load without particularly complicated constitution.

When the protrusion 178 reaches the end portion of the protrusion engaging groove 156 by turning the clamp 164 by a little over 90° as mentioned above, the protrusion 178 is pushed up so as to enter the depression 162 by applying repulsive force of the element peripheral end portion 26 (see FIG. 18B) elastically pressed to shrink by the flange 30 pushed down by the lower surface 172. The dot-dash lines in FIG. 20 shows a state where the fastening is completed by turning to the end as such. Therefore, in the fastening completed state, pressing force applied to the outer peripheral surfacetop end 184 of the protrusion 178 from the inner wall surface 160 of the protrusion engaging groove 156 becomes slightly smaller than that just before entering the depression 162. Accordingly, the protrusion 178 needs to return in the protrusion engaging groove 156 and further move to the base end against larger pressing force than the pressing force in the fastened state in order to get out of the depression 162, therefore, in this embodiment, unfastening due to vibration and so on during use is preferably controlled.

An embodiment according to the invention has been described in detail with reference to the drawings; however, the invention is capable of being practiced in still another form.

In the previously described embodiment, for example, a case where the fastening structure of the invention is applied to the air cleaner apparatus 10 has been described, however, it may be equally applied to a fastening structure of apparatuses or articles for other various uses as long as two parts are elastically pressed and fastened at their peripheries.

Moreover, in the embodiment a case in which the flanges 28,30 of relatively high elastic modulus are fastened with the element peripheral portion 26 of relatively low elastic modulus sandwiched therebetween, whereby a strong fastening structure can be obtained solely based on repulsive force of the element peripheral portion 26 and unfastening is controlled has been described, however, the existence of such an intermediate member of lower elastic modulus is not essential. For example, in a case when two parts whose a constituent member (flange 30 in the embodiment) of a surface to be pressed by a fastening part (hook rod or clamp) 40, 88, 110, 164 and so on having adequately low elastic modulus a strong fastening structure similar to in the embodiments can be obtained based on elastic deformation of the part having the low elastic modulus.

Although a case in which both of the case 16 and the cap 22 made of resin are fastened with a fastening part (hook rod 40 and so on) made of the similar resin as has been described in the embodiments, the invention is similarly applied to such a case that parts made of metal material are fastened, or a fastening part made of metal material is employed, as long as they are made of materials capable of applying above described elastic deformation. Both of two parts to be fastened may be made of inorganic materials or the like having an extremely low elastic modulus without any trouble as long as they are fastened through a member having a low elastic modulus such as the element peripheral portion 26.

In the fastening devices 34,76 as shown in FIG. 1 or FIG. 6 etc. first column-like portions 68,90 of hook rods 40,88 pressing the flange 30 has an oval-shape or an egg-shape in cross section having flat ends at the side of longer diameter, however, these shapes may suitably modified. In other words, as long as a cam surface is provided so that a distance from the turning axis center to the outer peripheral surface gradually increases in the peripheral direction, the first column-like portions 68,90 may have suitable configurations in cross section such as a full oval configuration without a flat surface 74, a circle-shape provided with a part having a large diameter, or rectangular or square shape being chamfered off.

In the previously described fastening apparatuses 34,76 the lower surfaces 50,84 provided to the hooks 36,78 for pressing the first column-like portions 68,90 toward the flange 30 as well as the hook 38 into which another end of the first column-like potions 68,90 is inserted are provided to the cap 22. However, in a case where inclination of the column-like potions 68,90 to be pressed by the hooks 36,78 can be controlled at the time of fastening or in the fastening state, the hook 38 may not be necessarily provided, for example, by having sufficiently high rigidity of the hooks 36,78 or sufficiently enlarged width of the lower surface 50.

Although the case 16 and the cap 22 are constituted to be turnable around the hinge device 32 provided at one side of their peripheries in the embodiment, the invention is equally applied to an air cleaner apparatus 10 being constituted so that the cap 22 is removed from the case 16 at the time of exchanging filter elements 24. In such a constitution, in order to positively maintain the fastened state of the case 16 and the cap 22, for example some kind of engaging structure may be provided to one side which was provided with the hinge device 32 or a fastening device 34 or the like may be provided to one side where the hinge device 32 was provided or the vicinity thereof.

Moreover, in the embodiment, a case in which the fastening device 34 or the like is provided at two positions at the peripheral portion of the case 16 and the cap 22 has been described, and the number thereof suitably set to such an extent that an adequate fastened state can be assured may be one or over three.

Although a case of fastening state in the fastening devices 34,76 by turning the hook rods 40,88 by about 90° from the direction substantially vertical to the flange 30 has been described, an initial direction or turning angles may be suitably modified. However, in order to control the situation of being unfastened by accidentally touching the hook roods 40,88 it is preferable that the hook rods 40,88 are constituted in the direction of axis center along the longitudinal direction of the flange 30 in the fastening state as shown in the embodiment.

In the previously mentioned fastening device 76, the guide groove 96 is provided to the peripheral surface 102 of the column-like portion 90 for guiding the hook rod 88 to stop at a predetermined position, when being turned in the direction of the arrow E as shown in FIG. 6, and guiding the protrusion 100 of the flange upper surface 46 with the depression 98 provided at the end portion to control the turning from the turning completed position, that is, the fastening position. However, the guide groove 96 may not be necessarily provided. In other words, since the hook rod 88 is turned in a state where both ends of the first column-like portion 90 are inserted to the hooks 78,38, the position of the protrusion 100 does not change so much even without the guide groove 96 being engaged thereto, and the turning to the loosening direction hardly occurs because the first column-like portion 90 has been turned further by the angle θ from a vertex of an egg-shaped section in the fastened state, therefore, there is no particular trouble in fastening the case 16 and the cap 22 even without an engaging structure such as above.

Moreover, the first column-like portions 68,90 of the hook rods 40,88 are formed to have substantially equal section in the direction of axis center in the fastening devices 34,76, however, they do not contribute to pressing of the flange 30 except a part with which the hooks 36,78 slides to contact and may have a full circular section without any trouble.

Moreover, in the fastening devices 34,76 relations in size of the longer diameter-the shorter diameter of the first column-like portions 68,90 and the diameters of the second column-like portions 70,92 are not limited to those shown in the embodiment, and the first column-like portions 68,90 may not be necessarily provided to project in the radial direction of the second column-like portions 70,92.

In the fastening device 76, a part in the outer peripheral surface 102 of the first column-like portion 90 with which the lower surface 84 of the hook 78 slides to be in contact was constituted so that the distance from the turning axis center changes in the peripheral direction, however, even if the part to be slidably contacted with has a full circular section and the part with which the upper surface 46 of the flange 30 slides to be in contact is constituted so that the distance from the turning axis center changes in the peripheral direction, similar effects in pressing and fastening can be obtained.

In the previously-mentioned fastening device 104, its constituent element, a hook rod inserting portion 108, is formed to project to the outer peripheral side from a part of the flange 30 of the cap 22. However, the length of the projecting portion 120 is set based on relations in size of the width of the flange 30 and the diameter of the engaging portion 128 of the clamp 110 so that an area required to turn the clamp 110 can be assured. In other words, when the diameter of the clamp 110 is made larger relative to width of the flange 30 than that shown in the embodiment the projecting portion 120 is preferably made larger, and when the diameter of the clamp 110 is small, the length of the projecting portion 120 may be small or may not be provided by providing a hole or a notch to be inserted by the hook rod 110.

Moreover, in the previously-mentioned fastening apparatus 104, the protrusion support surface 140 with which the protrusion 116 of the hook rod 106 is to be in contact is positioned as the entirety lower than the upper surface 132 of the clamp 110. However, the inner periphery side end portion is formed on the same level as the plan surface of the upper surface 132, depression 142 may be formed by recessing at a part of the upper surface 132.

In the fastening device as shown in FIG. 18 to FIG. 20, the protrusion inserting groove 154 and the protrusion engaging groove 156 which are provided to the hook rod 150 have the opening width being the same as the diameter of the protrusion 178 provided to the clamp 164, however, the size of opening width may be suitably modified to an extent that it is larger than the diameter of the protrusion 178.

While the protrusion inserting groove 154 and the protrusion engaging groove 156 which are provided to the hook rod 150 and the protrusion 178 provided to the clamp 164 are provided at two symmetrical positions in the turning axis center direction in the embodiment, only one or about three thereof may be provided.

Other embodiments have not be illustrated. However, the invention is capable of being practiced as an embodiment in which various modifications are made without departing from the point.

The present invention includes a first peripheral portion of a first part and a second peripheral portion of a second part are put together and pressed to each other, whereby the first part and the second part are fastened. This fastening structure includes a first engaging portion provided with a first sliding contact surface facing to the second peripheral portion side at the opposite side to the first part in relation to the second peripheral portion and extending to the second part from the first part, a second engaging portion provided to the fastening part so as to be engaged with the first engaging portion and be relatively turnable around the predetermined turning axis, a second sliding contact surface provided to the second engaging portion so as to come in contact with the first sliding contact surface in the engaged state of the fastening part with the first engaging portion wherein pressing force applied from the first sliding contact surface increases as the fastening part is turned around a predetermined turning axis in the fastening direction, a peripheral portion pressing surface provided to the fastening part so as to press the second peripheral portion toward the first peripheral portion based on the pressing force and an operating part provided to the fastening part at a predetermined interval from the turning axis in order to turn the second engaging part around the turning axis against the first engaging part in the predetermined turning axis direction.

In such a manner, when the first peripheral portion of the first part and the second peripheral portion of the second part are put together and the second engaging portion of the fastening part is engaged with the first engaging portion extending from the first part and then the second engaging portion is turned against the first engaging portion in the fastening direction by operating the operating part of the fastening part, pressing force according to the turning amount is applied to the second sliding contact surface from the first sliding contact surface facing to the side of the second peripheral portion and based on this pressing force the peripheral portion pressing surface of the fastening part presses the second peripheral portion toward the first peripheral portion, whereby the first peripheral portion and the second peripheral portion are fastened. At this time, the required force for turning the second engaging portion, that is, assembly load is smaller as a fulcrum-point of force-application distance from the turning axis center to the operating part in relation to a fulcrum-working point distance from the turning axis center to the peripheral portion pressing surface increases, however, the fulcrum-working point distance can be set small regardless of a thickness of the first peripheral portion and the second peripheral portion to such an extent that the torsional stress being applied to the fulcrum does not exceed the tolerable value. Therefore, a fastening structure capable of reducing the assembly load with a simple constitution can be obtained.

In the fastening structure of this aspect, the second sliding contact surface may preferably be provided so that the pressing force being applied from the first sliding contact surface in the fastened state is smaller than pressing force at the position where the second engaging portion is slightly turned in the opposite direction to the fastening direction, that is, in the loosening direction. As a result, because a larger pressing force than that in the fastened state is required to be applied to the second sliding contact surface from the first sliding contact surface for releasing the fastened state, the occurrence of unfastening by turning the second engaging portion in the reverse direction to the fastening direction due to external causes such as vibration is preferably controlled. The above-mentioned pressing force to be larger as relatively turning in the fastening direction is not limited to those embodiments strictly satisfying the condition in the entire area of the relative turning of the second engaging portion and the first engaging portion, but it is sufficient even if the large-small relations of the pressing force may be reversed in the vicinity of the fastening completed position as mentioned above as long as there is a tendency of increasing in the fastening direction as the entirety.

Moreover, in the fastening structure of the aspect, the fastening part preferably has a T-shape provided with a second column-like portion vertical to the direction of the axis center at the intermediate portion in the direction of the axis center of the first column-like portion, the first engaging portion is constituted by a leg portion extending to the second part side from the first peripheral portion, a first sliding contact portion extending along the second peripheral portion from the extreme ends of the leg portion and provided with the first sliding contact surface parallel to the opposite surface to the first part in relation to the second peripheral portion, wherein the second engaging portion is constituted by one end portion of the first column-like portion to turn around the direction of the axis center by being fitted in between the surface of the outer peripheral portion and the first sliding contact surface in the direction of the axial center vertical to the longitudinal direction of the second peripheral portion and parallel to the first sliding contact surface, the second sliding contact surface is provided to an outer peripheral surface of the second engaging portion in which a distance from the turning axis in the contacting point with the first sliding contact surface increases as the second engaging portion is turned in the fastening direction, the peripheral portion pressing surface is constituted at a part opposite to the second sliding contact surface in the peripheral direction on the outer periphery surface of the first column-like potion, and the operating part may be constituted by the extreme end at the opposite side to the first column-like portion of the second column-like portion.

In such a manner, the second engaging portion is fitted in between the surface of the second peripheral portion and the first sliding contact surface to be engaged with the first engaging portion, an operating part constituted by an extreme end of the second column-like portion is turned within a surface vertical to the direction of the axis center of the first column-like portion, that is, a surface parallel to the side surface of the second part, whereby the second sliding contact surface wherein a distance from the turning axis center increases as turned to the fastening direction is pressed by the first sliding contact surface, and further the second peripheral portion is pressed toward the first peripheral portion by the peripheral portion pressing surface of the second engaging portion to fasten the first part and the second part. Therefore, a strong fastened state can be obtained by a simple operation of fitting the second engaging portion in the first engaging portion and turning the same. Moreover, since the operating part turns in a direction within a surface parallel to the side surface of the second part, a distance between a point of force-application and a fulcrum point may be large without obtaining a space for the turning. Therefore, the assembly load can be further reduced.

Moreover, a third engaging portion to control the movement of the first column-like portion in the vertical direction to the direction of the axis center may be included by fitting the other end opposite to the second engaging portion of the first column-like portion provided to the side surface of the second part at a facing position to the first engaging portion. In such a manner, the useless movement of the first column-like portion in the vertical direction to the direction of the axis center can be controlled by the third engaging portion, whereby the second engaging portion can be turned more easily and unfastening due to the movement of the other end is further inhibited.

Further, a fitting convex portion and a fitting concave portion which control the movement of the second column-like portion in the direction of the axis center may be provided to one and the other of the surface of the second peripheral portion and the first column-like portion, respectively, by being fitted in each other in the fastened state. Thus, since the movement of the second column-like portion in the direction of the axis center in the fastened state can be controlled, unfastening is further inhibited. For example, in a form provided with the third engaging portion as described above, the other end of the first column-like portion is inhibited from coming off from the third engaging portion and further the second engaging portion and the first engaging portion are inhibited from being disengaged. The fitting concave portion may be constituted, for example, by one or a plurality of peripheral grooves provided to the first column-like portion, and the fitting convex portion may be constituted, for example, by a protrusion provided on the surface of the second peripheral portion.

Moreover, in the fastened state the second column-like portion may have an oval-shape in cross section in the longitudinal direction substantially corresponding to the direction facing to the first sliding contact surface from the surface of the second peripheral portion. In such a manner, the second engaging portion is turned to the fastening direction, whereby a distance from the turning axis center to the second sliding contact surface in the contact portion with the first sliding contact surface is gradually increased, therefore, the first peripheral portion and the second peripheral portion are fastened while being pressed. More preferably, both ends of the cross section of the second column-like portion in the longitudinal direction may be formed to be substantially flat surfaces. In such a manner, the substantially flat surfaces are pressed by the first sliding contact surface in the fastened state, whereby the turning from the fastening state to the opposite direction to the fastening direction or unfastening can be preferably controlled.

Further preferably, the first engaging portion has a hook-configuration having an opened extreme end of the first sliding contact portion. Such a configuration enables the second engaging portion to fit between the first sliding contact surface and the surface of the second peripheral portion from the opening side, therefore, the second engaging portion can be more easily engaged with the first engaging portion compared to the first engaging portion having a square-shape formed by laying the first sliding contact portion between the extreme ends of a pair of leg portions.

Moreover, preferably, in the fastening structure of the aspect, the first engaging portion may be constituted in a column-like shape in the direction of the axis center parallel to the direction vertical to the surface of the second peripheral portion with an engaging convex portion provided to project in the radial direction at a position apart from the first part further than the surface in which a part on the surface side of the second peripheral portion in the outer peripheral surface functions as the first sliding contact surface. The second engaging portion may be constituted with an inner peripheral surface facing to an outer peripheral surface of the first engaging portion so as to be engaged with the outer periphery side. The second sliding contact surface may be formed on the outer periphery side of the inner peripheral surface with inclination wherein a part contacting with the engaging convex portion in the surface side of the second engaging portion positioned on the opposite side to the second peripheral portion departs from the second peripheral portion as the second engaging portion turns in the fastening direction.

As a result, when the second engaging portion is engaged with the outer periphery side of the first engaging portion and the second engaging portion is turned in the fastening direction in relation to the first engaging portion while the engaging convex portion slides to contact with the second sliding contact surface, the engaging convex portion is guided in the direction apart from the second peripheral portion while sliding to contact with the second sliding contact surface according to the inclination of the second sliding contact surface. Therefore, pressing force applied to the second sliding contact surface is increased and further the entire fastening part is pressed by the second peripheral portion side, whereby the peripheral portion pressing surface presses the second peripheral portion toward the first peripheral portion to fasten them in the pressing state.

Moreover, the second sliding contact surface may be constituted to have a engaging convex portion securing groove formed by making the interval with the second peripheral portion slightly smaller than a part of the other end side in one end portion of the direction apart from the second peripheral portion. Thus, pressing force applied to the second sliding contact surface from the engaging convex portion positioned in the engaging convex portion securing groove becomes smaller than pressing force in a case of positioning an engaging concave portion on the side of the other end. Therefore, the fastened state that hardly comes off is preferably realized even in case of external causes such as vibration or the like.

One and the other of a peripheral protrusion and peripheral groove to be engaged with each other concentric with the axis center of the first engaging portion that is the turning axis center are respectively provided to an extent of contacting with each other on the surface of the second peripheral portion and the back surface of the fastening part. Thus, in turning the fastening part, the turning axis center can be easily maintained as being concentric with the axis center of the first engaging portion, whereby the turning and further fastening of the first part and the second part become easier.

Moreover, preferably, in the fastening structure of the aspect, the first engaging portion may be constituted in a column-like shape extending in the direction of the axis center along the vertical direction to the surface of the second peripheral portion with a periphery groove in which an inner wall surface at the extreme end side formed at the outer peripheral surface to be apart from the extreme end as proceeding in a direction of the peripheral direction functions as the first sliding contact surface and an inserting opening ranging from the extreme end surface to the peripheral groove. The second engaging portion may have an inner peripheral surface facing to the outer peripheral surface of the first engaging portion so as to be engaged with the outer peripheral side. The second sliding contact surface may exist at a part of the extreme end side in the outer peripheral surface of the protrusion to be fitted in the peripheral groove formed to project at the inner peripheral surface of the second engaging portion.

As a result, when the second engaging portion is engaged with the outer periphery side of the first engaging portion and the protrusion provided to the inner peripheral surface is fitted in the peripheral groove through the inserting opening followed by turning the second engaging portion against the first engaging portion in the above-mentioned direction, that is, in the fastening direction, the protrusion of the second engaging portion wherein the outer peripheral surface serves as the second sliding contact surface is guided in the approaching direction to the second peripheral portion, while sliding to be in contact with the extreme end side inner wall surface along the inclination of the peripheral groove extreme end inner wall surface serving as the first sliding contact surface. Therefore, pressing force applied to the protrusion from the extreme end inner wall surface increases as engagement increases as the fastening part as the entirety is pressed to the second peripheral portion end side, whereby the peripheral portion pressing surface is pressed by the second peripheral portion toward the first peripheral portion to be brought into fastening in the pressing state.

Further, there may be provided a pair of the inserting openings and the peripheral grooves at symmetrical positions in the peripheral direction on the outer peripheral surface of the first engaging portion and a pair of the protrusions to be fitted in the pair of the peripheral grooves to the inner peripheral surface of the second engaging portion. As a result, since the pair of the peripheral grooves and the pair of the protrusions are provided at the symmetrical positions, respectively, the second engaging portion is generally uniformly pressed in the peripheral direction from the first engaging portion through the pair of the protrusions. Therefore, at the time of the fastening operation wherein the second engaging portion is relatively turned against the first engaging portion, the second engaging portion is inclined to the first engaging portion resulting in preferably controlling the increase in the assembly load to further ease the required engagement effort, and at the same time inclination in the direction of the axis center of the first engaging portion is inhibited so that the occurrence of unfastening is further controlled.

Preferably, the first part and the second part may be constructed to be fastened with intervention of a third part whose elastic modulus is lower than that of the first part or the second part. As a result, pressing force applied to the second sliding contact surface from the first sliding contact surface increases to elastically deform solely the third part, therefore further increasing the strength of the fastening structure according to the elastic modulus and further restraining force can be obtained.

Preferably, the first part and the second part are a case and a cap, respectively, in an air cleaner apparatus for a vehicle, and the third part is a filter element accommodated therein. Thus, in an engine room in which the space volume is required to be reduced as much as possible for facilities, safety and the like, the air cleaner preferably does not require a large volume as a result of use of the fastening structure of the present invention.

Moreover, all of the first part, the second part and the fastening part may be preferably made of resin. Since the elastic deformed volume required to the fastening part and the like in each form of the fastening structure as previously mentioned is small compared to a clamp made of metal, resin of larger elastic modulus than that of metal may be employed. Therefore, since a fastening part can be molded with one mold simultaneously with the first part and the second part, the manufacturing processes are simplified and the manufacturing costs are advantageously lowered compared to the case of employing a metal part.

Further, the fastening part may be molded in a connected state with either of the first part and the second part. Thus, the fastening part is molded integrally with the first part or the second part to maintain the integral state during the storage, the conveyance and the like, whereby labor in connection with the control of a small fastening part relative to the first part and the second part can be reduced. Incidentally, the fastening part may be used as being integrated with the first part and the second part if there is no trouble at the time of fastening and may be departed from them at the assembly site, if necessary.

What is claimed is:

1. An air cleaner apparatus for a vehicle including fastening structure for fastening a first part and a second part by placing a first peripheral portion of the first part and a second peripheral portion of the second part one on top of the other and pressing the first peripheral portion and the second peripheral portion with a fastening part comprising:

a first engaging portion provided with a first sliding contact surface on a second part side of the first peripheral portion of the first part, wherein the first sliding contact surface is facing the first peripheral portion of the first part and the second peripheral portion of the second part when the first peripheral portion and the second peripheral portion are placed one top of the other;

a second engaging portion which engages with the first engaging portion when the second engaging portion is rotated in a fastening direction around a predetermined turning axis;

a second sliding contact surface provided on the second engaging portion so as to be in contact with the first sliding contact surface in an engaged state of the fastening part with the first engaging portion, wherein pressing force applied from the first sliding contact surface increases as the fastening part is turned in the fastening direction around the predetermined turning axis;

a pressing surface provided on the fastening part so as to press the second peripheral portion toward the first peripheral portion as the pressing force is applied; and an operating part provided with the fastening part at a predetermined interval from the predetermined turning axis for turning the second engaging portion against the first engaging portion, wherein the first part and the second part are intially held apart by intervention of a third part whose elastic modulus is lower than elastic modulus of the first peripheral portion and of the second peripheral portion, and wherein the first part and the second part are a case and a cap, respectively, of the cleaner apparatus, and the third part is a filter element sandwiched between the case and the cap.

2. The fastening structure according to claim 1, wherein the second sliding contact surface is provided so that the pressing force being applied from the first sliding contact surface in the fastened state is smaller than the pressing force at a position where the second engaging portion is slightly turned in the opposite direction to the fastening direction from a position wherein the second engaging portion is in the fastened state.

3. The fastening structure according to claim 1, wherein the fastening part has a T-shape provided with a first column-like portion and a second column-like portion perpendicular to the first column-like portion and located at an intermediate position along the length of the first column-like portion, wherein the first engaging portion has a leg portion extending to the second part side from the first peripheral portion, a first sliding contact surface extending along the second peripheral portion from extreme ends of the leg portion and parallel to the opposing surface of the first peripheral portion of the first part, wherein the second engaging portion is constituted by one end portion of the first column-like portion of the fastening part to turn around a predetermined turning axis by being fitted in between the first sliding contact surface and the opposing surface of the first peripheral portion of the first part, wherein the second sliding contact surface is provided on an outer peripheral surface of the second engaging portion, in which a distance from the predetermined turning axis to the contacting point with the first sliding contact surface increases as the second engaging portion is turned in the fastening direction, wherein the peripheral portion pressing surface is constituted at a part of the first column-like portion opposite to the second sliding contact surface in the peripheral direction on the outer periphery surface of the first column-like portion, and further wherein the operating part is constituted by the end of the second column-like portion opposite the end of the second column-like portion which joins the first column-like portion.

4. The fastening structure according to claim 3, further comprising:

a third engaging portion, wherein said third engaging portion is located on the second part at a position facing the first engaging portion and restricts the movement of the first column-like portion in the vertical direction relative to the predetermined turning axis by fitting the end of the first column-like portion opposite the end of the first column-like portion containing the second engaging portion into said third engaging portion.

5. The fastening structure according to claim 3, wherein a fitting convex portion and a fitting concave portion are provided to the surface of the second peripheral portion and the first column-like portion, respectively, wherein the fitting convex portion and the fitting concave portion restrict the movement of the second column-like portion in the direction of the predetermined turning axis by being fitted in each other in the fastened state.

6. The fastening structure according to claim 3, wherein the second column-like portion has an oval-shape in cross section in its longitudinal direction substantially corresponding to the direction facing to the first sliding contact surface from the surface of the second peripheral portion.

7. The fastening structure according to claim 3, wherein the first engaging portion has a hook-configuration having an opened extreme end of the first sliding contact surface.

8. The fastening structure according to claim 1, wherein the first engaging portion has an engaging convex portion which is in a column-like shape in the direction perpendicular to the pressing force-bearing surface of the second peripheral portion and is projected in the radial direction at a position apart from the first part further than the surface, a part on the surface side of the second peripheral portion in the outer peripheral surface functions as the first sliding contact surface, and the second engaging portion is constituted with an inner peripheral surface facing to an outer peripheral surface of the first engaging portion so as to be engaged with the outer periphery side, and the second sliding contact surface is formed on the outer periphery side of the inner peripheral surface with inclination wherein a part contacting with the engaging convex portion in the surface side of the second engaging portion positioned on the opposite side to the second peripheral portion departs from the second peripheral portion as the second engaging portion turns in the fastening direction.

9. The fastening structure according to claim 8, wherein the second sliding contact surface has a engaging convex portion securing groove formed by making the interval with the second peripheral portion slightly smaller than a part of the other end side in one end portion of the direction apart from the second peripheral portion.

10. The fastening structure according to claim 8, wherein either one of peripheral protrusion and peripheral groove are respectively provided to an extent of contacting between a surface of the second peripheral portion and a back surface of the fastening part on the surface of the second peripheral portion and the back surface of the fastening part, the peripheral protrusion and peripheral groove are engaged with each other concentric with the axis of the first engaging portion that is the predetermined turning axis.

11. The fastening structure according to claim 1, wherein the first engaging portion is constituted in a column-like shape extending in the direction perpendicular to the pressing force-bearing surface of the second peripheral portion, a periphery groove is formed at outer peripheral surface of the first engaging portion in which an inner wall surface of the periphery groove formed to be apart from an extreme end of the first engaging portion as proceeding to a direction of the peripheral direction functions as the first sliding contact surface, and an inserting opening ranging from the extreme end of the first engaging portion to the peripheral groove is formed at outer peripheral portion, and further wherein the second engaging portion is provided with a member which has an inner peripheral surface facing to the outer peripheral surface of the first engaging portion so as to be engaged with the outer peripheral side, and the second sliding contact surface is constituted at a part of the extreme end side in the outer peripheral surface of the protrusion to be fitted in the peripheral groove formed to project at the inner peripheral surface of the second engaging portion.

12. The fastening structure according to claim 11, wherein a pair of the inserting opening and the peripheral groove are provided at symmetrical positions in the peripheral direction on the outer peripheral surface of the first engaging portion, and the protrusion fitted in the peripheral groove is provided to the inner peripheral surface of the second engaging portion.

13. The fastening structure according to claim 1, wherein the first part, the second part and the fastening part are made of resin.

14. The fastening structure according to claim 1, wherein the fastening part is molded in a connected state with either of the first part and the second part.

* * * * *